US005929556A

United States Patent [19]

Matsubara et al.

[11] Patent Number: 5,929,556

[45] Date of Patent: Jul. 27, 1999

[54] SPARK PLUG WITH CENTER ELECTRODE HAVING VARIABLE DIAMETER PORTION RETRACTED FROM FRONT END ON INSULATOR

[75] Inventors: Yoshihiro Matsubara; Akio Kokubu; Kazumasa Yoshida, all of Nagoya, Japan

[73] Assignee: NGK Spark Plug Co., Ltd., Aichi, Japan

[21] Appl. No.: 08/746,766

[22] Filed: Nov. 15, 1996

[30] Foreign Application Priority Data

Nov. 16, 1995 [JP] Japan ..... 7-298381
Oct. 31, 1996 [JP] Japan ..... 8-289789

[51] Int. Cl.[6] ..... H01T 13/14; H01T 13/52

[52] U.S. Cl. ..... 313/141; 313/139

[58] Field of Search ..... 313/141, 139

[56] References Cited

U.S. PATENT DOCUMENTS

| | | | |
|---|---|---|---|
| 3,870,918 | 3/1975 | Senda et al. | 313/131 R |
| 4,845,400 | 7/1989 | Takamura et al. | 313/142 |
| 5,124,612 | 6/1992 | Takamura et al. | 313/141 |
| 5,159,232 | 10/1992 | Sato et al. | 313/141 |
| 5,239,225 | 8/1993 | Moriya et al. | 313/141 |
| 5,574,329 | 11/1996 | Kagawa | 313/141 |
| 5,581,145 | 12/1996 | Kato et al. | 313/141 |

FOREIGN PATENT DOCUMENTS

| | | | |
|---|---|---|---|
| 1 446 036 | 6/1966 | France . | |
| 42-8250 | 4/1967 | Japan . | |
| 58-40831 | 9/1983 | Japan | H01T 13/46 |
| 1 127 187 | 9/1968 | United Kingdom | F23Q 3/48 |

*Primary Examiner*—Nimeshkumar D. Patel
*Attorney, Agent, or Firm*—Sughrue, Mion, Zinn, Macpeak & Seas, PLLC

[57] ABSTRACT

In a spark plug in use for an internal combustion engine, a ground electrode is secured to a front end of the metal shell so that a front end surface of the ground electrode faces an elevational side of a front end of the center electrode to cause semi-creeping spark discharges therebetween along a front end surface of the insulator. A front end portion of the center electrode has an electrode base in the axial bore and an electrode front defined diametrically smaller than the electrode base by way of a diameter-variable portion. A diametrical difference between an initial point of the diameter-variable portion of the center electrode and the axial bore of the insulator is 1 mm or less, and the initial point of the diameter-variable portion is retracted by 0.0 mm–1.0 mm from the front end surface of the insulator.

19 Claims, 18 Drawing Sheets

Di=2. 6, Dc=2. 5, d=2. 0, G=1. 1
Gs=0. 6, L=0. 3, Pi=1. 5

SPARK PLUG WITH CENTER ELECTRODE HAVING VARIABLE DIAMETER PORTION RETRACTED FROM FRONT END ON INSULATOR

BACKGROUND OF THE INVENTION

1. Field of the Invention

The invention relates to a spark plug for an internal combustion engine improved to positively effect a self-cleaning action.

2. Description of Prior Art

In a spark plug used for a high compression engine and lean burn enging, an ignitable condition deteriorates to cause smolder on a front end surface of the insulator by depositing unburned material thereon such as carbon, oily residue or unburnable fuel ingredient.

For this reason, it has been demanded to burn out the unburned material deposited on a front end surface of the insulator. In order to effectively burn out the unburned material to improve a carbon-fouling resistance, an auxiliary gap type spark plug is disclosed by Japanese Patent Publication No. 58-40831 (referred to as "a first reference"hereinafter) in which an annular space is formed between a front end of an insulator and a diameter-reduced portion of a center electrode so as to define an auxiliary spark gap between a front end surface of the insulator and an inner side of an outer electrode.

In an auxiliary gap type spark plug disclosed by a Provisionally Published Japanese Patent Application No. 2-181383 (referred to as "a second reference" hereinafter), a carbon deposit piled on the insulator is burned out by spark discharges induced from a high voltage power source. Namely, it is possible to remove the carbon deposit exposed to an ionized region due to the induced voltage among the spark discharges across the center and ground electrodes.

In U.S. Pat. Nos. 4,845,400, 5,124,612 and 5,159,232 (referred in turn to as "a third, fourth and fifth reference"hereinafter), it is possible to burn out the carbon deposit piled on the insulator and exposed to the induced voltage in the same manner as described in the second reference.

In the auxiliary gap type spark plug disclosed by the first reference, however, it is not satisfactory to effect the self-cleaning action for the shortage of technology which enables to positively creep the spark discharge along the front end surface of the insulator.

In the auxiliary gap type spark plug disclosed by the second reference, it is necessary to determine a distance between a front end of an insulator and that of a center electrode to be 1.1 mm or less in order to located the front end of the insulator within the ionized region. Namely, the distance is such that the front end of the insulator positions within the ionized region even in the case in which a spark-initiated point with the center electrode is not in the front end of the insulator.

In the spark plug disclosed by the third reference, it is necessary to determine a front end dimension of a center electrode to be 1.0 mm or less from a front end of an insulator upon considering a diametrical relationship between the front end of the center electrode and an axial bore of the insulator.

In the spark plug disclosed by the fourth reference, it is necessary to provide a stepped portion with a center electrode which is placed within an axial bore of an insulator.

In the spark plug disclosed by the fifth reference, it is necessary to establish a dimensional relationship as 0.6 mm≦d≦1.55 mm in which (d) shows a diameter of a diameter-reduced front end of a center electrode. This is because of the necessity of providing an annular space between an inner wall of an axial bore of an insulator and the diameter-reduced front end of a center electrode.

Therefore, it is a main object of the invention to provide a spark plug which is capable of positively effect the self-cleaning action when the carbon-related deposit is piled on the front end surface of the insulator.

SUMMARY OF THE INVENTION

According to the present invnetion, there is provided a spark plug for an internal combustion engine comprising: an insulator having an axial bore, and placed in a cylindrical metal shell to extend a front end of the insulator beyond the metal shell; a center electrode placed within the axial bore of the insulator so that a front end of the center electrode extends beyond the insulator; a ground electrode secured to a front end of the metal shell directly or through a front end of the insulator so that a front end surface of the ground electrode faces an elevational side of a front end of the center electrode to form a semi-creeping spark discharge gap therebetween along a front end surface of the insulator; a front end portion of the center electrode having an electrode base in the axial bore and an electrode front defined diametrically smaller than the electrode base by way of a diameter-variable portion; and a diametrical difference between an initial point of the diameter-variable portion of the center electrode and the axial bore of the insulator being 1 mm or less, the initial point of the diameter-variable portion being retracted by 0.0 mm–1.0 mm from the front end surface of the insulator.

According to another aspect of the present invention, there is provided a spark plug for an internal combustion engine comprising: an insulator having an axial bore, and placed in a cylindrical metal shell to extend a front end of the insulator beyond the metal shell; a center electrode placed within the axial bore of the insulator so that a front end of the center electrode extends beyond the insulator; a ground electrode secured to a front end of the metal shell so that a front end surface of the ground electrode faces an elevational side of a front end of the center electrode to form an air-gap therebetween so as to usually cause air gap spark discharges across the air-gap while causing semi-creeping spark discharges along a front end surface of the insulator when the insulator is fouled; a front end portion of the center electrode having an electrode base in the axial bore and an electrode front defined diametrically smaller than the electrode base by way of a diameter-variable portion; and a diametrical difference between an initial point of the diameter-variable portion of the center electrode and the axial bore of the insulator being 1 mm or less, the initial point of the diameter-variable portion being retracted by 0.0 mm–1.0 mm from the front end surface of the insulator.

According to other aspect of the present invention, there is provided a spark plug for an internal combustion engine comprising: a cylindrical metal shell having an annular projection extending inward from a front end of the metal shell; an insulator having an axial bore, and placed in the cylindrical metal shell to extend a front end of the insulator beyond the metal shell; a center electrode placed within the axial bore of the insulator so that a front end of the center electrode extends beyond the insulator; a ground electrode secured to a front end of the metal shell so that a front end surface of the ground electrode faces an elevational side of a front end of the center electrode to form an air-gap therebetween so as to cause air gap discharges across the air-gap; a front end portion of the center electrode having an electrode base in the axial bore and an electrode front defined diametrically smaller than the electrode base by way of a diameter-variable portion; and a diametrical difference between an initial point of the diameter-variable portion of the center electrode and the axial bore of the insulator being 1 mm or less, the initial point of the diameter-variable portion being retracted by 0.0 mm–1.0 mm from the front end surface of the insulator.

According to other aspect of the present invention, there is provided a spark plug for an internal combustion engine comprising: a cylindrical metal shell having an annular projection extending inward from a front end of the metal shell; an insulator having an axial bore, and placed in a cylindrical metal shell to extend a front end of the insulator beyond the metal shell; a center electrode placed within the axial bore of the insulator so that a front end of the center electrode extends by 1.2 mm or more beyond the insulator; a parallel ground electrode secured to a front end of the metal shell so that an inner side of the parallel ground electrode faces a front end surface of the center electrode to form an air-gap therebetween so as to casue air gap spark discharges across the air gap; a front end portion of the center electrode having an electrode base in the axial bore and an electrode front defined diametrically smaller than the electrode base by way of a diameter-variable portion; and a diametrical difference between an initial point of the diameter-variable portion of the center electrode and the axial bore of the insulator being 1 mm or less, the initial point of the diameter-variable portion being retracted by 0.0 mm–1.0 mm from the front end surface of the insulator.

According to other aspect of the present invention, there is provided a spark plug for an internal combustion engine comprising: a cylindrical metal shell having an annular projection extending inward from a front end of the metal shell; an insulator having an axial bore, and placed in a cylindrical metal shell to extend a front end of the insulator beyond the metal shell; a center electrode placed within the axial bore of the insulator so that a front end of the center electrode extends by 1.2 mm or more beyond the insulator; a ground electrode secured to a front end of the metal shell so that a front end of the ground electrode faces an elevational side of the center electrode to form a semi-creeping spark gap therebetween along an front end surface of the insulator; a parallel outer electrode secured to a front end of the metal shell so that an inner side of the parallel outer electrode faces a front end surface of the center electrode to cause air spark discharges therebetween; a front end portion of the center electrode having an electrode base in the axial bore and an electrode front defined diametrically smaller than the electrode base by way of a diameter-variable portion; and a diametrical difference between an initial point of the diameter-variable portion of the center electrode and the axial bore of the insulator being 1 mm or less, the initial point of the diameter-variable portion being retracted by 0.0 mm–1.0 mm from the front end surface of the insulator.

According to other aspect of the present invention, the diameter-variable portion of the front portion of the center electrode is behind by 0.1 mm to 0.6 mm from the front end surface of the insulator.

According to other aspect of the present invention, a diameter of the electrode base of the center electrode is 1.5 mm or less.

According to other aspect of the present invention, a noble metal tip is secured to a firing side defined at least on either the front end surface or the elevational side of the center electrode.

According to other aspect of the present invention, a noble metal tip is secured to a firing side defined at least on either the front end surface of the ground electrode, the annular projection of the metal shell or the inner side of the parallel ground electrode.

According to other aspect of the present invention, an inner edge of a front open end of the insulator is chamfered by 0.1 mm to 0.4 mm in terms of length dimension.

According to other aspect of the present invention, the number of the outer electrode is three or more.

According to other aspect of the present invention, the noble metal tip is made of Pt, Pt-Ni, Pt-Ir-Ni or Ir-Y2O3.

According to other aspect of the present invention, the noble metal tip is laser beam or resistance welded in integral with the electrode.

According to other aspect of the present invention, the noble metal tip measures 0.6 mm–1.5 mm in diameter.

According to other aspect of the present invention, the diameter-variable portion is formed into a frusto-cone shaped configuration, and a front end of the diameter-variable portion serves as an edge portion which is retracted by 0.0 mm–1.0 mm from the front end surface of the insulator.

According to other aspect of the present invention, the diameter-variable portion is formed into a column-shaped configuration, and a front end of the diameter-variable portion serves as an edge portion which is retracted by 0.0 mm–1.0 mm from the front end surface of the insulator.

According to other aspect of the present invention, the diameter-variable portion is formed into a frusto-cone shaped configuration, and a diameter-reduced front end of the diameter-variable portion being diametrically the same as the electrode front of the center electrode, and a diameter-enlarged rear end of the diameter-variable portion being retracted by 0.0 mm–1.0 mm from the front end surface of the insulator.

Such is the structure that the front end portion of the center electrode has an electrode base in the axial bore and an electrode front defined diametrically smaller than the electrode base by way of a diameter-variable portion, and a diametrical difference between an initial point of the diameter-variable portion of the center electrode and the axial bore of the insulator being 1 mm or less, the initial point of the diameter-variable portion being retracted by 0.0 mm–1.0 mm from the front end surface of the insulator.

That is to say, because the semi-creeping spark discharges are initiated from the initial point of the diameter-variable portion, the initial point is retracted by 0.0 mm–1.0 mm from the front end surface of the insulator in order to directly burn out the carbon-related matter deposited on the front end surface of the insulator due to the semi-creeping spark discharges when it is smoldered.

Upon piling the electrically conductive carbon-related deposit on the front end surface of the insulator, the surface creeping spark discharges occur between the front end surface of the ground electrode and the diameter-variable portion of the center electrode along the front end surface of the insulator so as to effectively burn out the carbon-related deposit, and thereby improving the self-cleaning action to achieve a good ignitability without inviting misfire when used to the high compression type engine or lean burn engine.

In addition to the structure that the front end portion of the center electrode has an electrode base in the axial bore and an electrode front defined diametrically smaller than the electrode base by way of a diameter-variable portion, and a diametrical difference between an initial point of the diameter-variable portion of the center electrode and the axial bore of the insulator being 1 mm or less with the initial point of the diameter-variable portion being retracted by 0.0 mm–1.0 mm from the front end surface of the insulator, the cylindrical metal shell has an annular projection extending inward from a front end of the metal shell.

That is to say, because the semi-creeping spark discharges are initiated from the initial point of the diameter-variable portion, the initial point is retracted by 0.0 mm–1.0 mm from the front end surface of the insulator in order to directly burn out the carbon-related matter deposited on the front end surface of the insulator due to the semi-creeping spark discharges when it is smoldered.

Upon piling the electrically conductive carbon-related deposit on the front end surface of the insulator, the surface creeping spark discharges occur between the annular projection of the metal shell (or a front end surface of the outer electrode) and the diameter-variable portion of the center electrode along the front end surface of the insulator so as to effectively burn out the carbon-related deposit, and thereby improving the self-cleaning action to achieve a good ignitability without inviting misfire when used to the high compression type engine or lean burn engine.

Upon decreasing an insulation voltage between the electrodes due to smoldering, it is possible to maintain the spark voltage smaller than an impressed voltage given by a high tension power source although the voltage impressed across the spark gap reduces by dividing the high voltage in proportion to an output impedance and the insulation resistance.

In addition to the structure that the front end portion of the center electrode has an electrode base in the axial bore and an electrode front defined diametrically smaller than the electrode base by way of a diameter-variable portion, and a diametrical difference between an initial point of the diameter-variable portion of the center electrode and the axial bore of the insulator being 1 mm or less with the initial point of the diameter-variable portion being retracted by 0.0 mm–1.0 mm from the front end surface of the insulator, a front end of the center electrode extends by 1.2 mm or more beyond the insulator.

Upon piling the electrically conductive carbon-related deposit on the front end surface of the insulator, the surface creeping spark discharges occur between the annular projection of the metal shell (or a front end surface of the outer electrode) and the diameter-variable portion of the center electrode along the front end surface of the insulator so as to effectively burn out the carbon-related deposit, and thereby improving the self-cleaning action to attain a good ignitability without inviting misfire when used to the high compression type engine or lean burn engine.

With the diameter-variable portion of the front portion of the center electrode placed behind by 0.1 mm to 1.0 mm from the front end surface of the insulator, it is possible to positively effect the self-cleaning action.

With a diameter of the front portion of the center electrode being 1.5 mm or less, it is possible to obtain a good ignitability, and at the same time, reducing a spark voltage required to initiate a spark discharge between the electrodes.

With the noble metal tip secured to a firing side defined at least on either the front end surface or the elevational side of the center electrode, it is possible to provide a spark erosion resistant property with the firing side of the center electrode.

With the noble metal tip secured to a firing side defined at least on either the front end surface of the ground electrode, an inner edge of the annular projection or an inner side of the parallel ground electrode, it is possible to provide a spark erosion resistant property with the firing side of the ground electrode.

With the inner edge of the front open end of the insulator chamfered by 0.1 mm to 0.4 mm to prevent cracks thereon due to channeling caused from the surface creeping spark discharges, it is possible to prevent an occurrence of cracks on the front open end of the insulator without sacrificing the carbon-fouling resistance.

With the number of the outer electrode being three or more, it is possible to effectively burn out the carbon-related material deposited on the front surface of the insulator.

DETAILED DESCRIPTION OF PREFERRED EMBODIMENTS OF THE INVENTION

Figure 1:
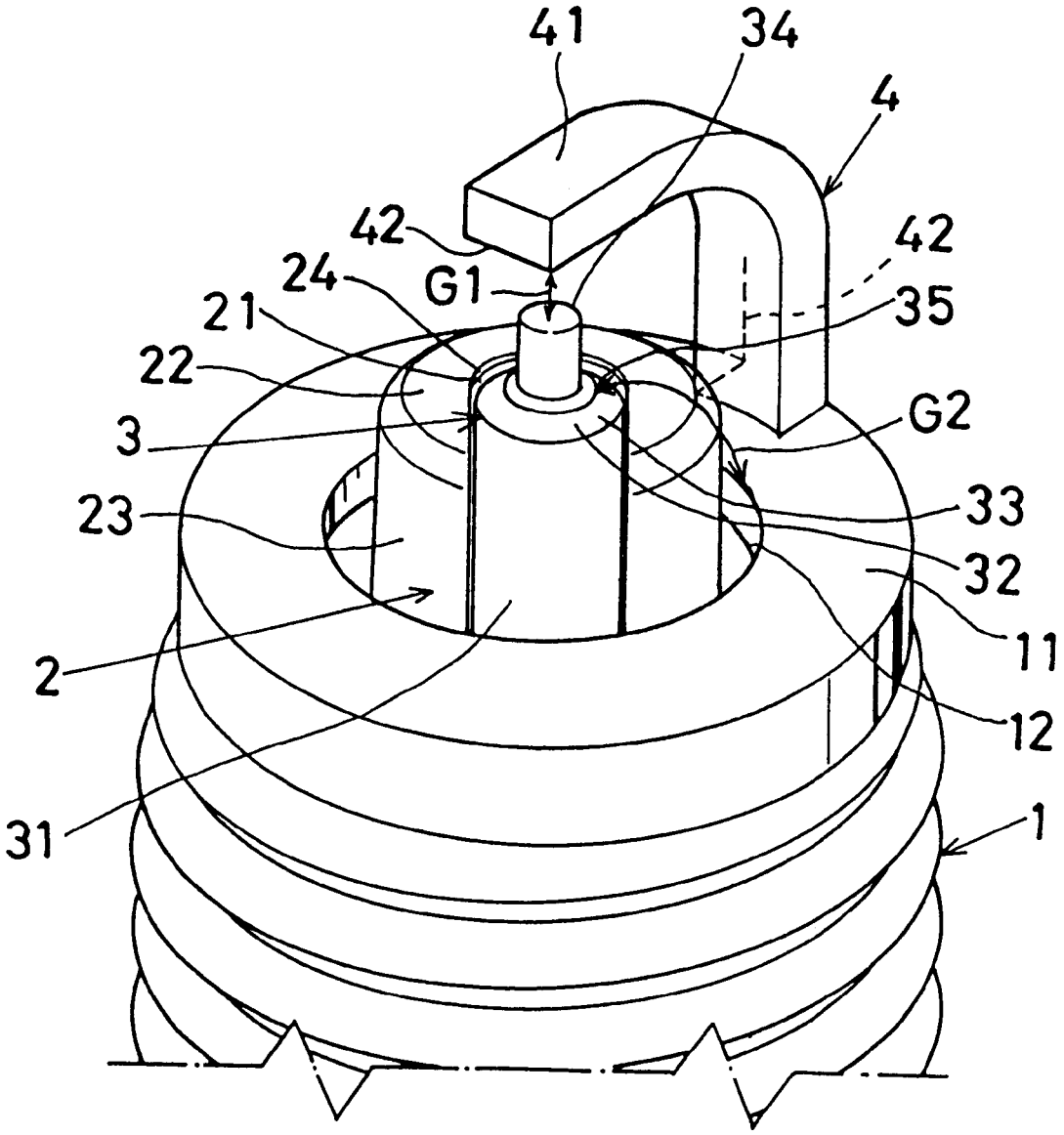
FIG. 1 is a perspective view of a front portion of a spark plug according to a first embodiment of the invention, but a front portion of an insulator is notched to reveal a front end of a center electrode.
Figure 2:
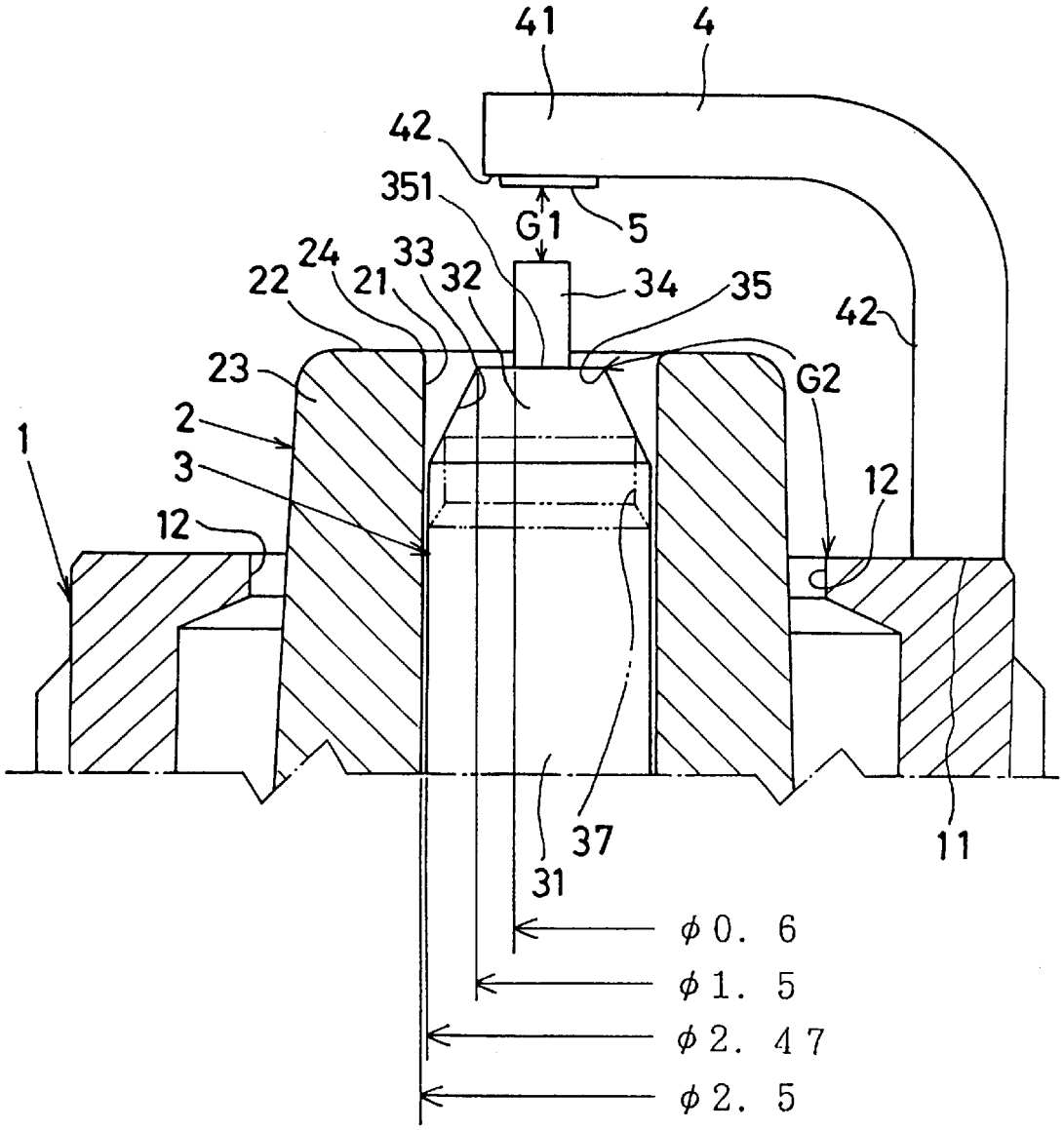
FIG. 2 is an enlarged longitudinal cross sectional view of the front portion of the spark plug according to a first embodiment of the invention.

Referring to FIGS. 1 and 2 which show a front portion of a spark plug for an internal combustion engine according to a first embodiment of the present invention, the spark plug has a cylindrical metal shell 1 and an insulator 2 placed within the metal shell 1. Within an axial bore 21 provided with the insulator 2, a center electrode 3 is cocentrically placed.

The center electrode 3 has an electrode base 31 and a frusto-cone shaped step portion 32 connected to the electrode base 31. On a front end surface of the step portion 32, a columnar noble metal tip 34 is placed as an electrode front by means of a welding procedure. An upper corner of the frusto-cone shaped step portion 32 serves as an edge 35 of an initial point of a diameter-variable portion which is formed by descending down along a tapered shoulder portion 33. As the diameter-variable portion, an upper flat surface 351 is provided from the edge 35 to an elevational side of the noble metal tip 34.

An inner diameter of the axial bore 21 is 2.5 mm at a leg portion 23 of the insulator 2, and an inner edge of an open end of the insulator 2 is rounded at numeral 24 by chamfering it by approx. 0.3 mm. The electrode base 31 of the center electrode 3 is formed into columnar configuration (2.47 mm in dia.) consisting of a heat-resistant nickel clad and a copper core embedded in the clad. The frusto-cone shaped step portion 32 measures 1.0 mm in length and 1.5 mm in front diameter, and the noble metal tip 34 measures 1.5 mm in length and 0.6 mm in diameter.

It is to be observed that as shown at phantom line in FIG. 2, a thermo-pocket 37 may be provided as an annular space between a front portion of the electrode base 31 and an inner wall of the insulator 2 so as to swiftly warm up the front end of the insulator upon running the internal combustion engine at a low speed. The thermo-pocket 37 measures approx. 3.0 mm in length and 2.4 mm in diameter.

In the step portion 32 of the center electrode 3, the edge 35 (initial point of the diameter-variable portion) is retracted inward by 0.0 mm–1.0 mm from a front end surface 22 of the insulator 2 while the noble metal tip 34 significantly extends outward from the front end surface 22 of the insulator 2.

To a front end surface 11 of the metal shell 1, an L-shaped parallel ground electrode 4 is welded whose front end 41 is directed to overlie a front end of the center electrode 3. The ground electrode 4 is made of a heat-resistant nickel alloy whose front end 41 is substantially perpendicular to an axial extension line of the center electrode 3.

To an inner side 42 (firing side) of the front end 41 of the ground electrode 4, a noble metal tip 5 is welded to form an air-gap (G1) with the noble metal tip 34 of the center electrode 3.

Along a passage path from the edge 35 of the step portion 32, a front end surface 22 of the insulator 2 and its periphery to an annular projection 12 provided with an inner wall of the front end 11 of the metal shell 1, a surface spark creeping gap (G2) is formed to run spark discharges therealong upon piling the carbon-related deposit on the front end surface 22 of the insulator 2. In this instance, the edge 35 of the step portion 32 specifies where the spark discharges occur across the surface spark creeping gap (G2).

The noble metal tips 34 and 5 are made from Pt, Pt-Ir, Pt-Ni, Pt-Ir-Ni, Ir-Y2O3 or the like. The noble metal tips 34 and 5 are secured respectively to electrode metals by means of an electric resistance welding or laser beam welding procedure. Provision of these noble metal tips 34 and 5 makes it possible to reduce the spark erosion of a firing portion of the center electrode 3 and the ground electrode 4 so as to prolong the service life of the spark plug.

In this instance, it is preferable that the noble metal tip 34 measures 0.6 mm–1.5 mm in diameter, and the edge 35 of the step portion 32 is retracted by 0.0 mm–1.0 mm from the front end surface 22 of the insulator 2. These numerical restriction is based on the following product quality estimation result of test pieces.

When the diameter of the noble metal tip 34 exceeds 1.5 mm, a higher spark discharge voltage is required while increasing an amount of costly noble metal material. The step portion 32 is retracted by 0.0 mm–1.0 mm from the front end surface 22 of the insulator 2 because it is necessary to run the spark discharges across the surface creeping spark discharge gap (G2) along the front end surface 22 of the insulator 2. When the edge 35 of the step portion 32 is retracted by more than 1.0 mm from the front end surface 22 of the insulator 2, it becomes difficult to reach an initial point sufficient to induce the semi-creeping spark discharge, thus reducing the satisfactory self-cleaning effect.

Figure 3A:
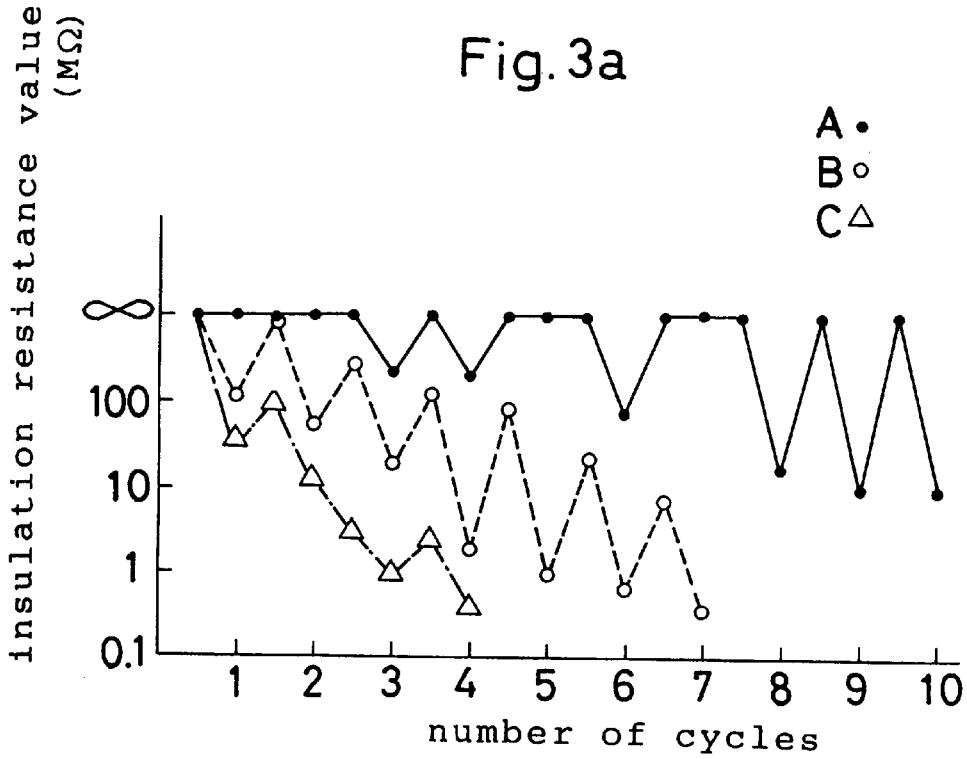
FIGS. 3*a* and 3*b* are graphical representations to show pre-deliverlity test results of the spark plug.

FIG. 3*a* shows a graph representing a relationship between an insulation resistance value and the number of test engine driving cycles. In the graph of FIG. 3*a*, notation (A) shows the spark plug of FIG. 1 in which the diameter of the electrode front is 0.6 mm, and the diameter of the edge 35 of the tapered shoulder portion 33 is 1.5 mm while maintaining the retracting distance by 0.5 mm. Notation (B) shows the dual-gap type spark plug in which the edge 35 of the step portion 32 is protracted from the front end surface 22 of the insulator 2. Notation (C) shows a general type spark plug in which the surface creeping spark discharge gap (G2) is not provided.

Figure 3B:
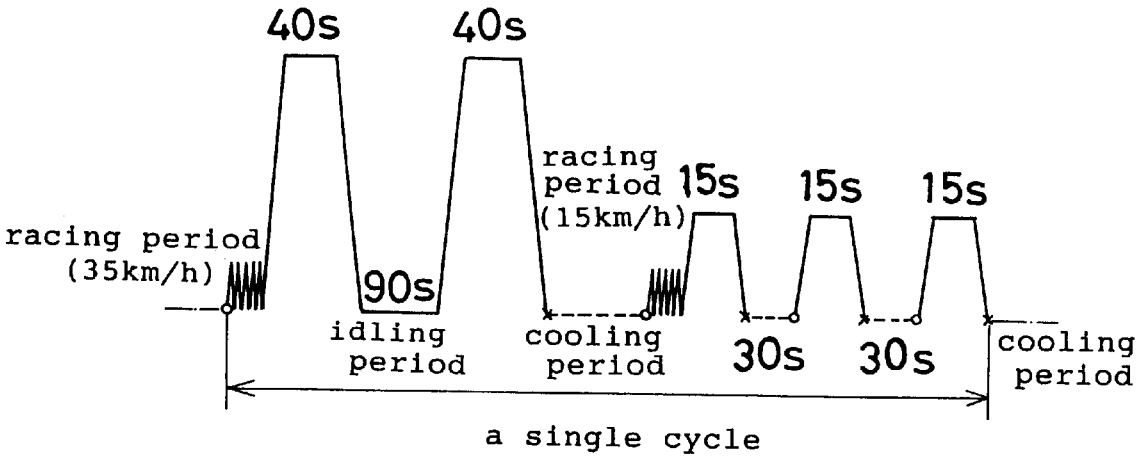

In any cases, the air-gap (G1) was 0.75 mm in width. As an experimental test condition, the engine was operated in the condition of −10° C. with a single cycle as shown by FIG. 3*b*. Each of the insulation resistance value was measured at the beginning of cooling the engine. It was found that the present spark plug was significantly superior in self-cleaning action with a low reduction of insulation resistance as shown by notation (A) in FIG. 3*a*.

Figure 4:
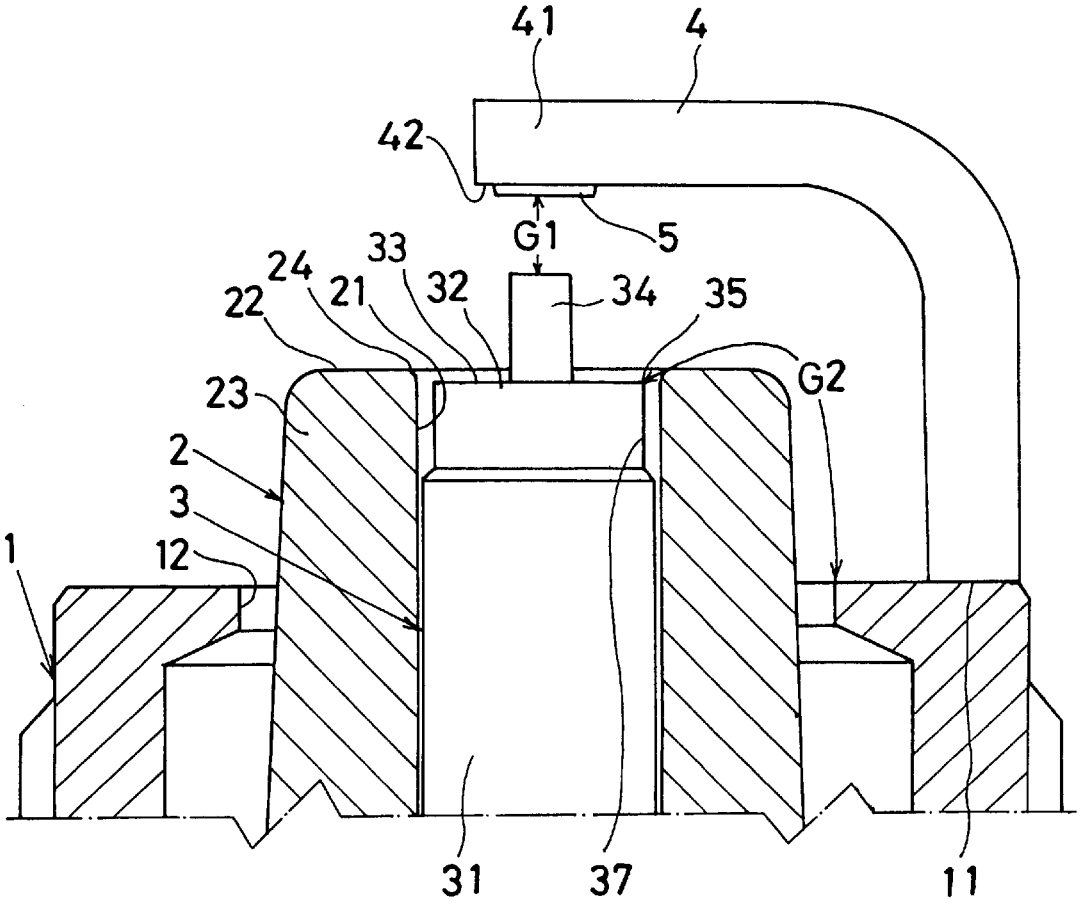
FIG. 4 is an enlarged longitudinal cross sectional view of a front portion of a spark plug according to a second embodiment of the invention.
Figure 5:
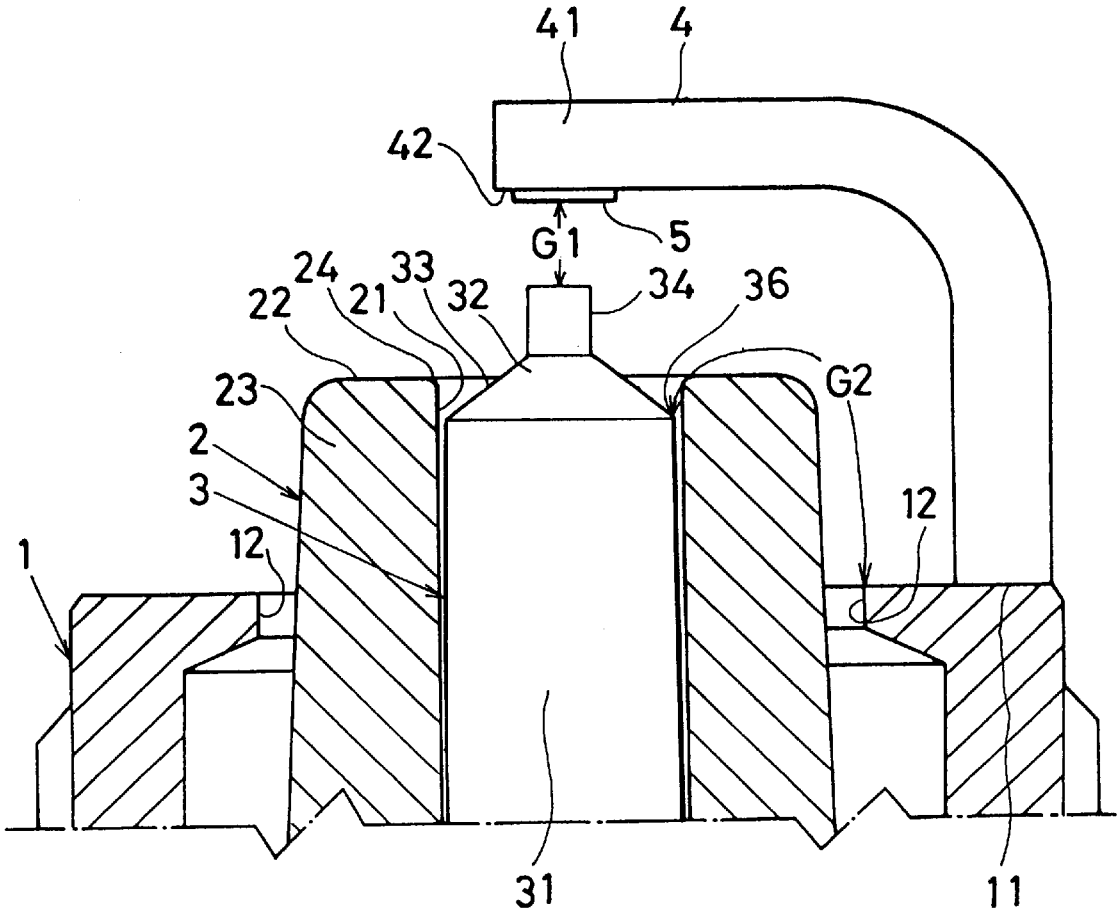
FIG. 5 is an enlarged longitudinal cross sectional view of a front portion of a spark plug according to a third embodiment of the invention.

FIGS. 4 and 5 respectively show a second and third embodiment of the present invention. The second embodiment of the present invention of FIG. 4 is different from the first embodiment of FIG. 2 in that the center electrode 3 has a thermo-pocket 37 on the electrode base 31 by providing a step portion 32 whose diameter is reduced to be smaller than the electrode base 31. A flat shoulder portion 33 of the step portion 32 is retracted from the front end surface 22 of the insulator 2 with the diametrically reduced noble metal tip 34 placed thereon.

The third embodiment of the present invention of FIG. 5 is different from the first embodiment of FIG. 2 in that the frusto-cone shaped step portion 32 is placed as a diameter-variable portion on a front end surface of the electrode base 31 of the center electrode 3, and a rear edge 36 of the step portion 32 serves as an initial point of the diameter-variable portion which is a flared end of the tapered shoulder portion 33 of the step portion 32. The rear edge 36 is retracted from the front end surface 22 of the insulator 2. The step portion 32 and the rear edge 36 corresponds in turn to the diameter-reduced portion and the initial point of the diameter-variable portion.

In these instances, upon smoldering the insulator 2, the spark discharges occur across the surface creeping spark discharge gap (G2) along the path from the edge 35 (36) of the shoulder portion 33 of the step portion 32 and the front end surface 22 of the insulator 2 to the annular projection 12 of the metal shell 1. In both embodiments of the invention, the spark plugs are as superior in carbon-fouling resistance as the first embodiment of the present invention.

In the above instances (FIGS. 2, 4 and 5), it is to be observed that instead of the discrete noble metal tip 34, the electrode front 31 may be made in integral with the step portion 32 of the center electrode 3. In order to reduce an amount of the costly noble metal material, a noble metal layer may be partly provided on the electrode front (0.6–1.5 mm in dia.) or spark discharge surfaces.

Figure 6:
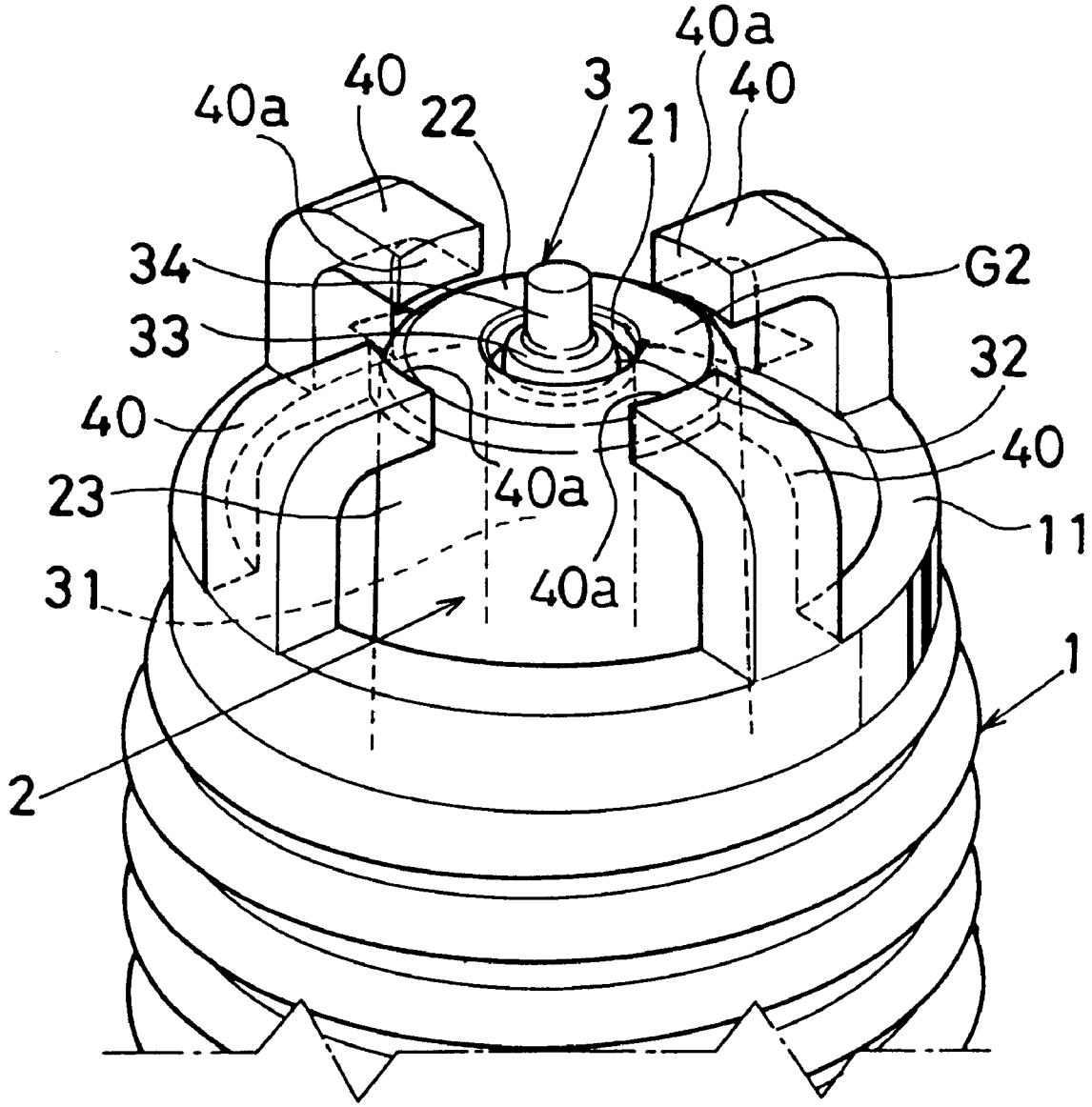
FIG. 6 is a perspective view of a front portion of a spark plug according to a fourth embodiment of the invention.

FIG. 6 shows a fourth embodiment of the present invention in which four ground electrodes 40 are provided to form a multi-gap type spark plug. In the fourth embodiment of the present invention, the front portion 23 of the insulator 2 extends beyond the front end 11 of the metal shell 1, and each front end 40*a* of the four ground electrodes 40 faces an elevational side of the noble metal tip 34 of the center electrode 3 by way of a semi-creeping spark discharge gap (G2) along the front end surface 22 of the insulator 2 so as to also form a semi-creeping type spark plug. In this instance, the number of ground electrodes is preferably 3 or 4.

With the structure of the semi-creeping type spark plug, it is possible to positively burn out the carbon-related material deposited on the front end surface 22 of the insulator 2. The semi-creeping spark discharge gap (G2) is located within a combustion chamber of the internal combustion engine upon mounting the spark plug on a cylinder head of the internal combustion engine, it is possible to significantly improve the ignitability.

Figure 7:
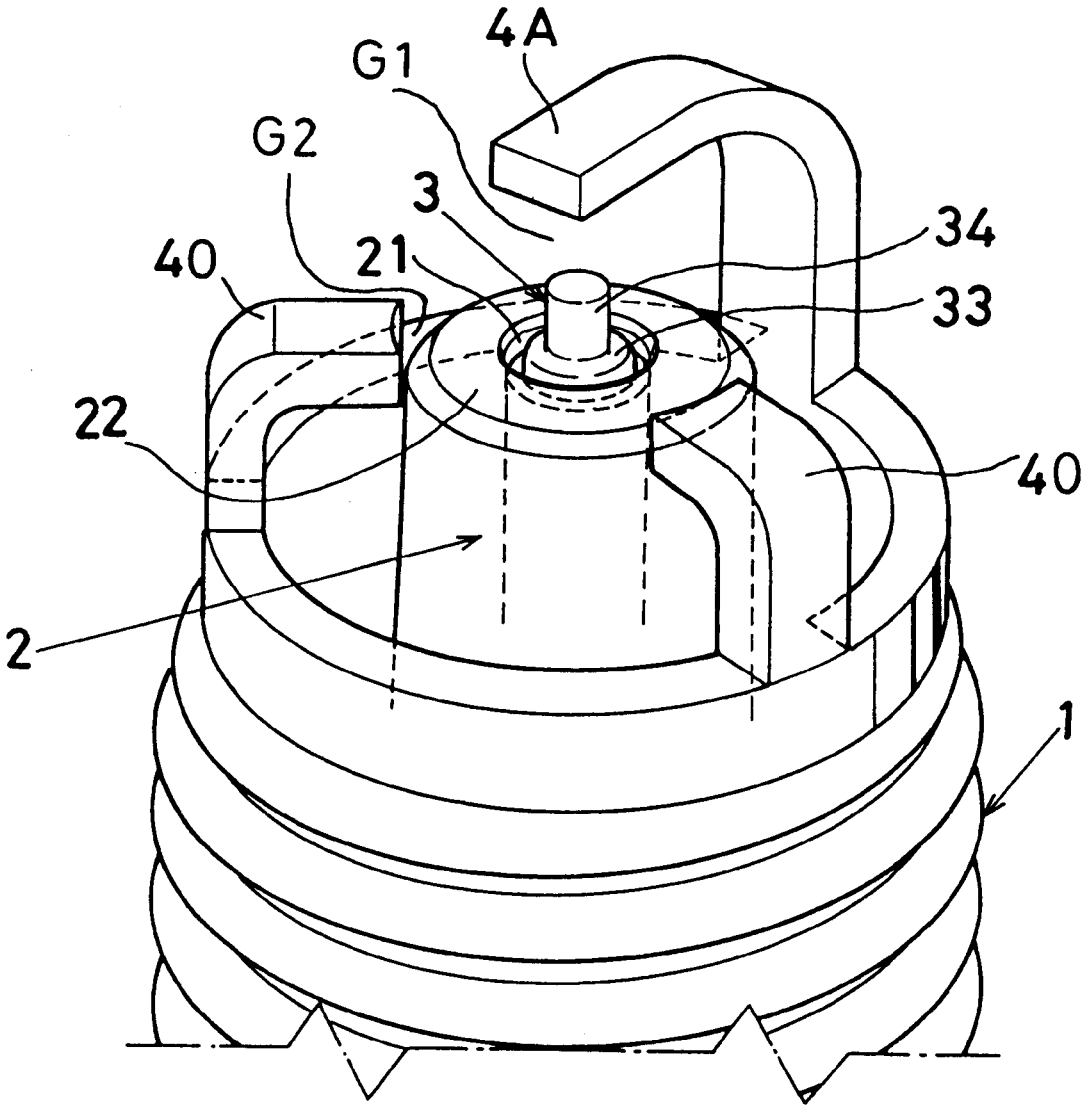
FIG. 7 is a perspective view of a front portion of a spark plug according to a fifth embodiment of the invention.

FIG. 7 shows a fifth embodiment of the present invention in which a plurality of ground electrodes 40 are provided to form the surface creeping spark discharge gap (G2), and a parallel ground electrode 4A is provided to form the air-gap (G1) with the front end surface of the noble metal tip 34. This combination of the ground electrodes 40, 4A makes it possible to ameliorate the carbon-fouling resistance, while at the same time, improving the ignitability even when the insulator 2 is smoldered because of the surface-creeping spark discharge gap (G2) projected more into the combustion chamber than that of FIGS. 1 and 2. In this instance, it is possible to ensure as good an ignitability as the general spark plug because the air gap spark discharge usually occurs across the air-gap (G1).

Figure 8:
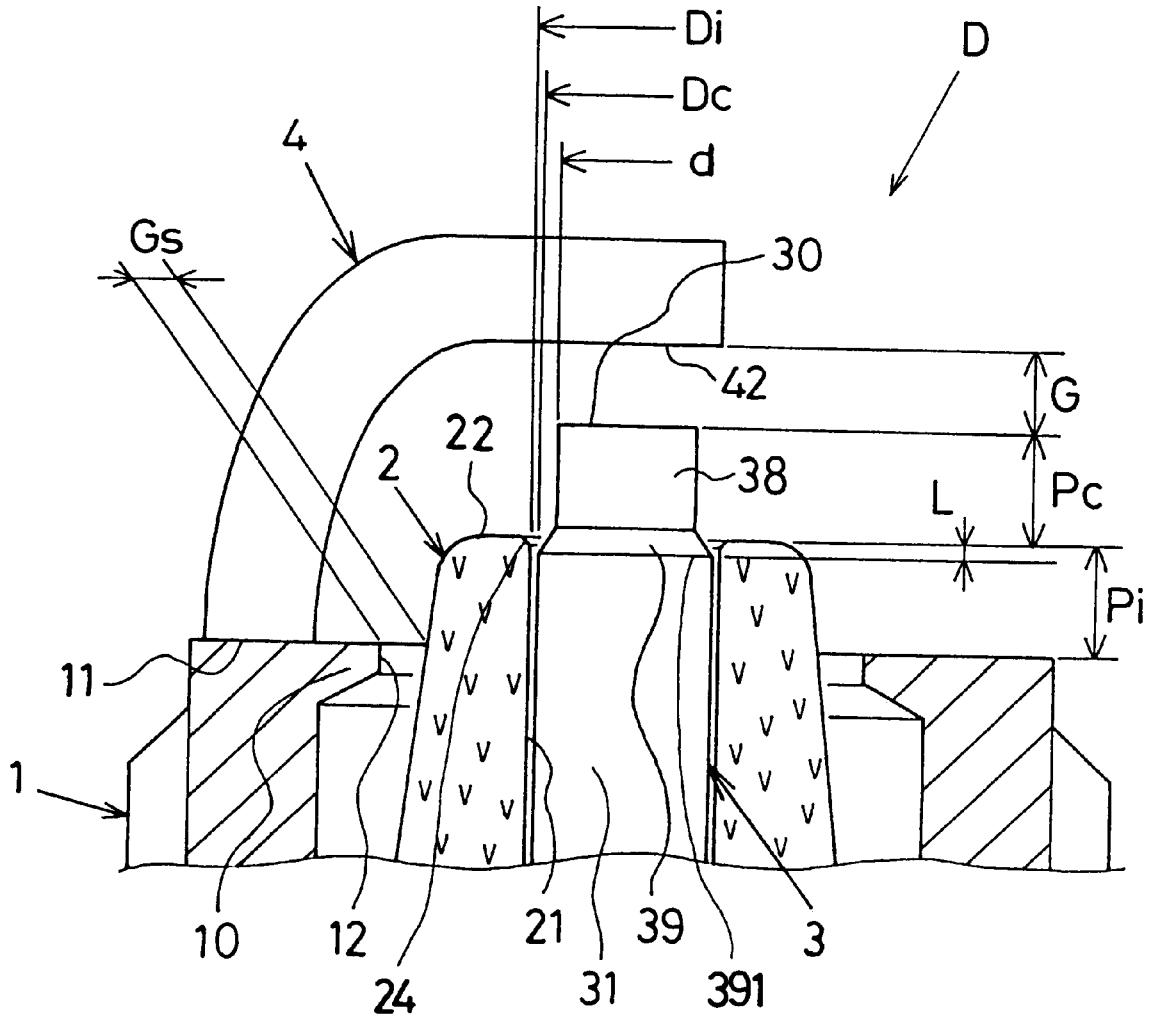
FIG. 8 is an enlarged longitudinal cross sectional view of a front end of a spark plug according to a sixth embodiment of the invention.

FIG. 8 shows a sixth embodiment of the present invention in which a spark plug (D) has the metal shell 1 whose front open end has an annular projection 10, and having the insulator 2 whose front end surface 22 extends by (Pi) from the front end 11 of the metal shell 1. The center electrode 3 is placed within the axial bore 21 of the insulator 2 with the electrode front 30 extending by 1.2 mm or more (Pc) from the front end surface 22 of the insulator 2.

At the front end 11 of the metal shell 1, the parellel ground electrode 4 is bent so that its front inner side 42 faces the electrode front surface 30 of the center electrode 3 by way of a spark gap (G) to discharge sparks between the front inner side 42 of the parallel ground electrode 4 and the electrode front surface 30 of the center electrode 3. An auxiliary spark gap distance (Gs) between an inner edge of the annular projection 10 and an outer surface of the insulator 2 is 0.6 mm.

The front portion of the center electrode 3 has the electrode base 31 in the axial bore 21, and having the electrode front 38 whose diameter is smaller than that of the electrode base 31. The electrode base 31 is connected to the electrode front 38 by way of the diameter-variable portion 39.

A preferable dimensional relationship is determined as follows.

(1) A dimensional difference (Di−Dc) between a diameter (Di) of the axial bore 21 and a diameter (Dc) of the initial point of the diameter-variable portion 39 is less than 1.0 mm.

Figure 9:
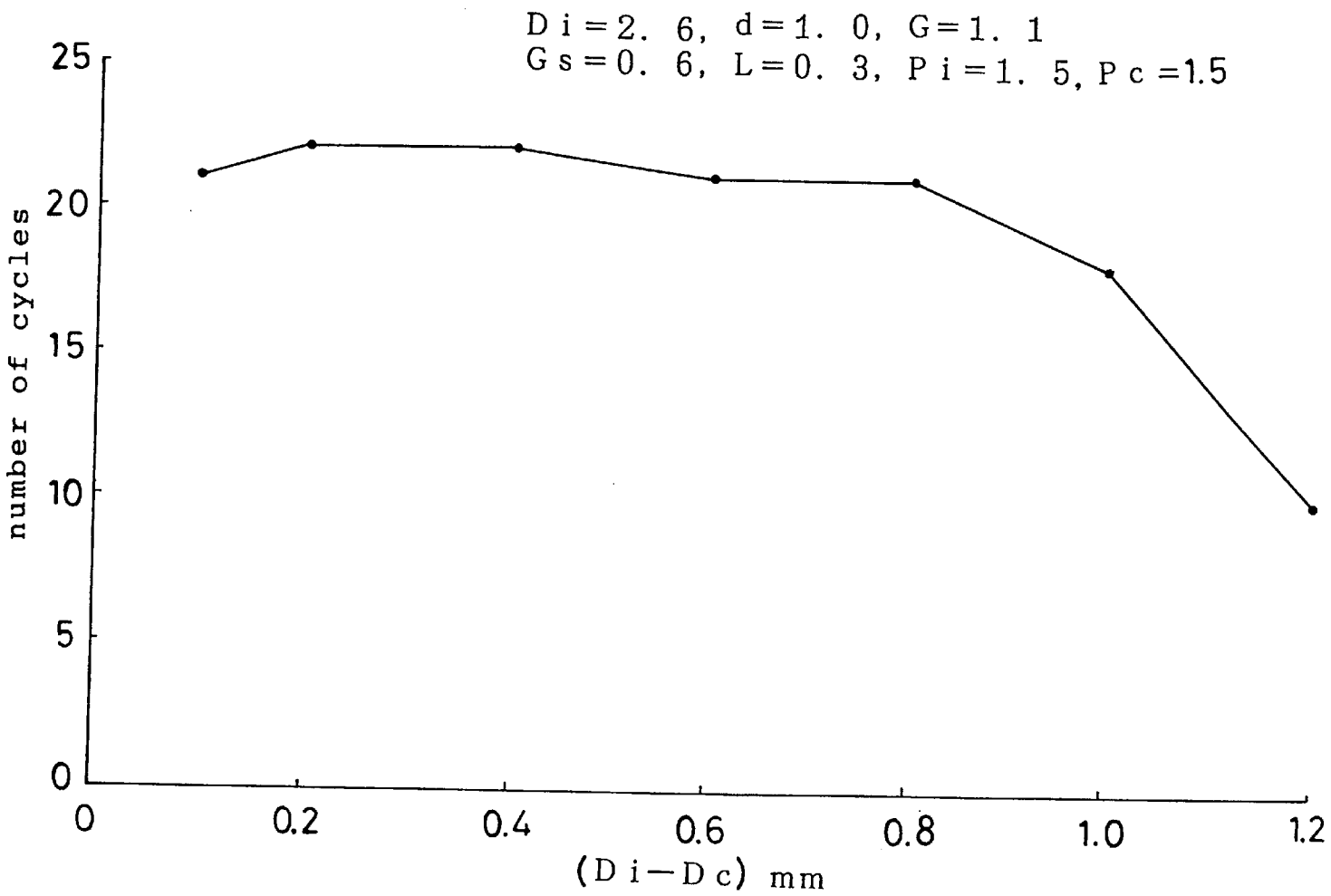
FIG. 9 is a graphical representation to show how the carbon foul resistance changes depending on a diametrical difference between an axial bore of an insulator and an initial point of a diameter-variable portion of a center electrode.

In view of experimental test results on carbon-fouling resistance shown by FIG. 9, it was found to be advantageous when the formula is $Di-Dc \leqq 1.0$ mm. The effect of the carbon-fouling resistance reduces when the initial point 391 (FIG. 14) of the diameter-variable portion 39 is far removed from the inner wall of the axial bore 21. The experimental test on the carbon-fouling resistance was carried out by changing the diameter (Dc) of the initial point of the diameter-variable portion 39.

Where, the diameter (Di) of the axial bore 21 is 2.6 mm;

the diameter (d) of the electrode front 38 is 1.0 mm;

the spark gap (G) is 1.1 mm;

the auxiliary spark gap distance (Gs) is 0.6 mm;

the distance (L) is 0.3 mm in which the initial point 391 of the diameter-variable portion 39 is retracted from the front end surface 22 of the insulator 2;

the extension length (Pi) is 1.5 mm in which the front end surface 22 of the insulator 2 extends from the front end 11 of the metal shell 1; and the projected length (Pc) is 1.5 mm in which the electrode front 30 extends from the front end surface 22 of the insulator 2.

(2) It is necessary that the initial point 391 of the diameter-variable portion 39 is retracted by 0.0 mm–0.6 mm, preferably 0.1 mm–0.6 mm from the front end surface 22 of the insulator 2.

Figure 10:
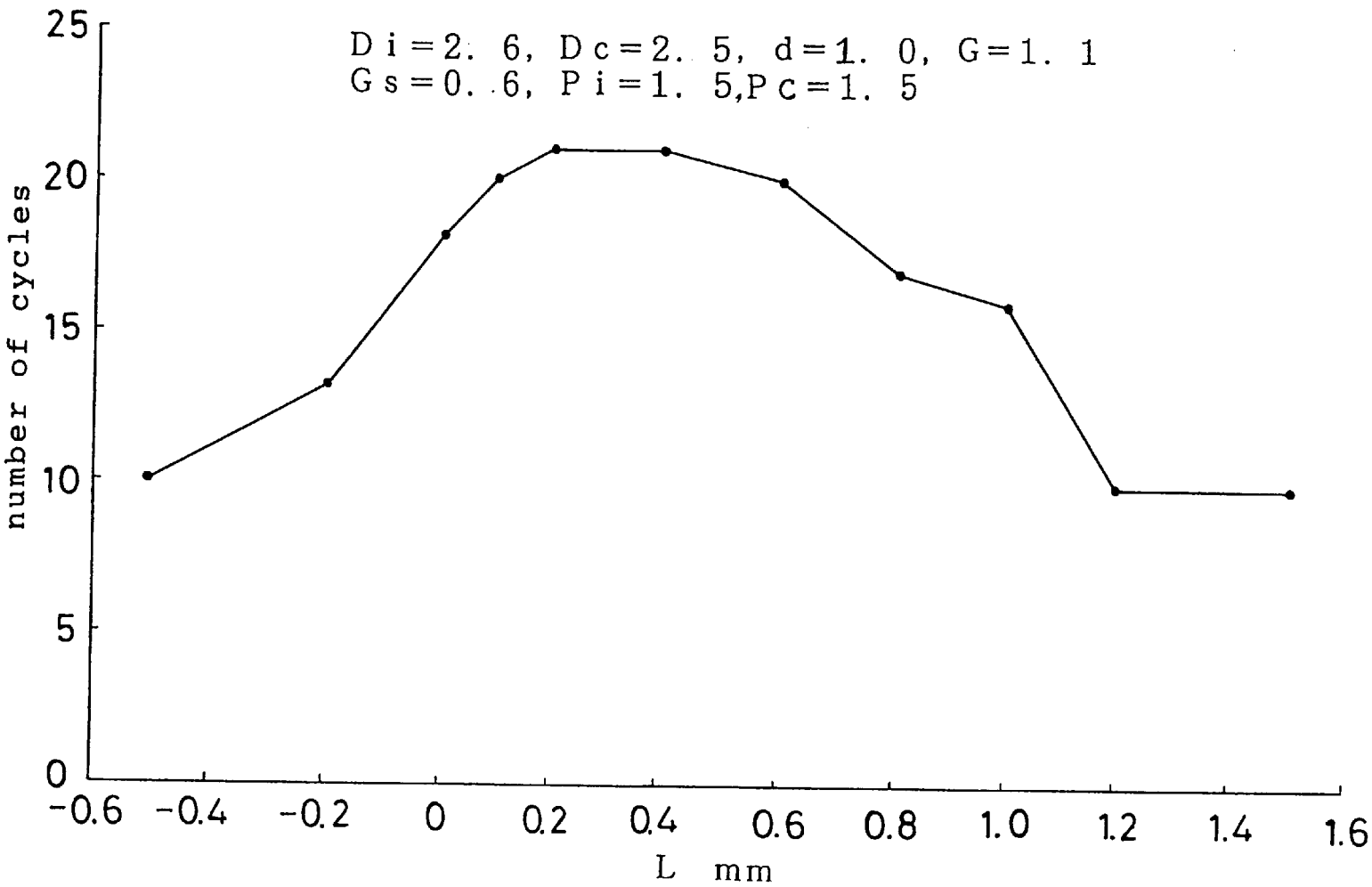
FIG. 10 is a graphical representation to show a relationship between the carbon foul resistance and a retracted distance (L)

In view of experimental test results on carbon-fouling resistance shown by FIG. 10, it was found to be advantageous when the retracted distance (L) is in the range of 0.1 mm–0.6 mm.

The experimental test on the carbon-fouling resistance was carried out by changing the retracted distance (L).

Where, the diameter (Di) is 2.6 mm;

the diameter (Dc) is 2.5 mm;

the diameter (d) is 1.0 mm;

the spark gap (G) is 1.1 mm;

the auxiliary spark gap distance (Gs) is 0.6 mm;

the extension length (Pi) is 1.5 mm; and the projected length (Pc) is 1.5 mm.

(3) It is necessary to determine the projected length (Pc) to be 1.2 mm or more in which the electrode front 30 extends from the front end surface 22 of the insulator 2.

Figure 11:
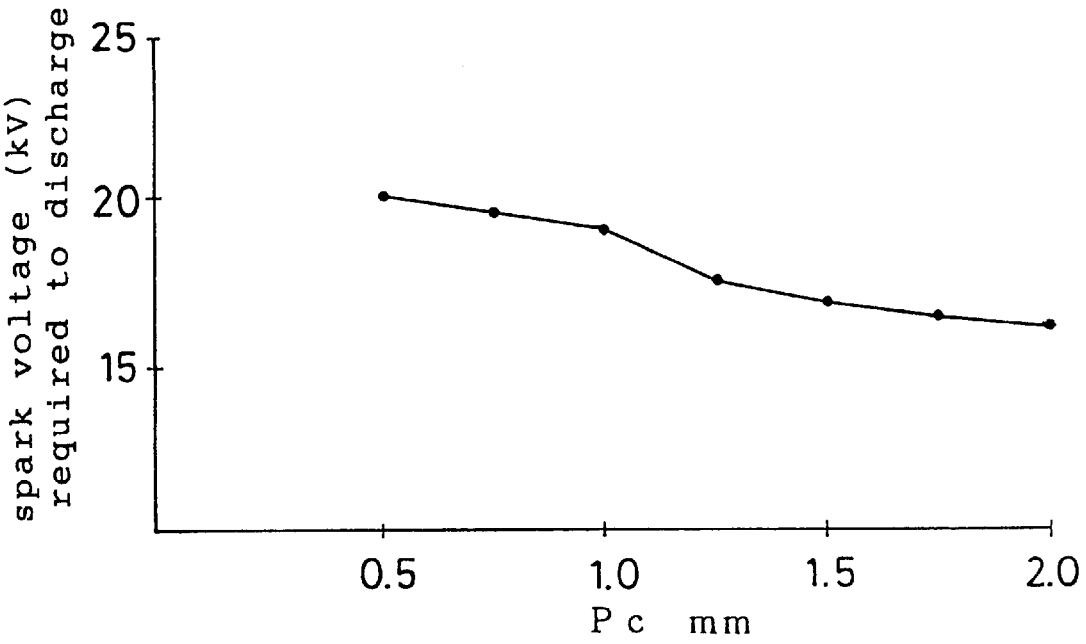
FIG. 11 is a graphical representation to show a relationship between a spark discharge voltage and a front end length of the center electrode extended from the insulator.

In view of experimental test results on discharge voltage by FIG. 11, it was found that there was a close relationship between the discharge voltage and the carbon-fouling resistance. Lowering the discharge voltage is one of the means to ameliorate the carbon-fouling resistance.

The experimental test on the discharge voltage was carried out by changing the projected length (Pc).

Where, the diameter (Di) is 2.6 mm;

the diameter (Dc) is 2.5 mm;

the diameter (d) is 2.0 mm;

the spark gap (G) is 1.1 mm;

the auxiliary spark gap distance (Gs) is 0.6 mm;

the extension length (Pi) is 1.5 mm; and the distance (L) is 0.3 mm.

(4) Upon providing the chamfer 24 on the open front of the axial bore 21 of the insulator 2 so as to prevent the cracks thereon due to the channeling phenomenon, it is necessary to determine the chamfer 24 in terms of length to be preferably 0.2 mm–0.4 mm.

Figure 12:
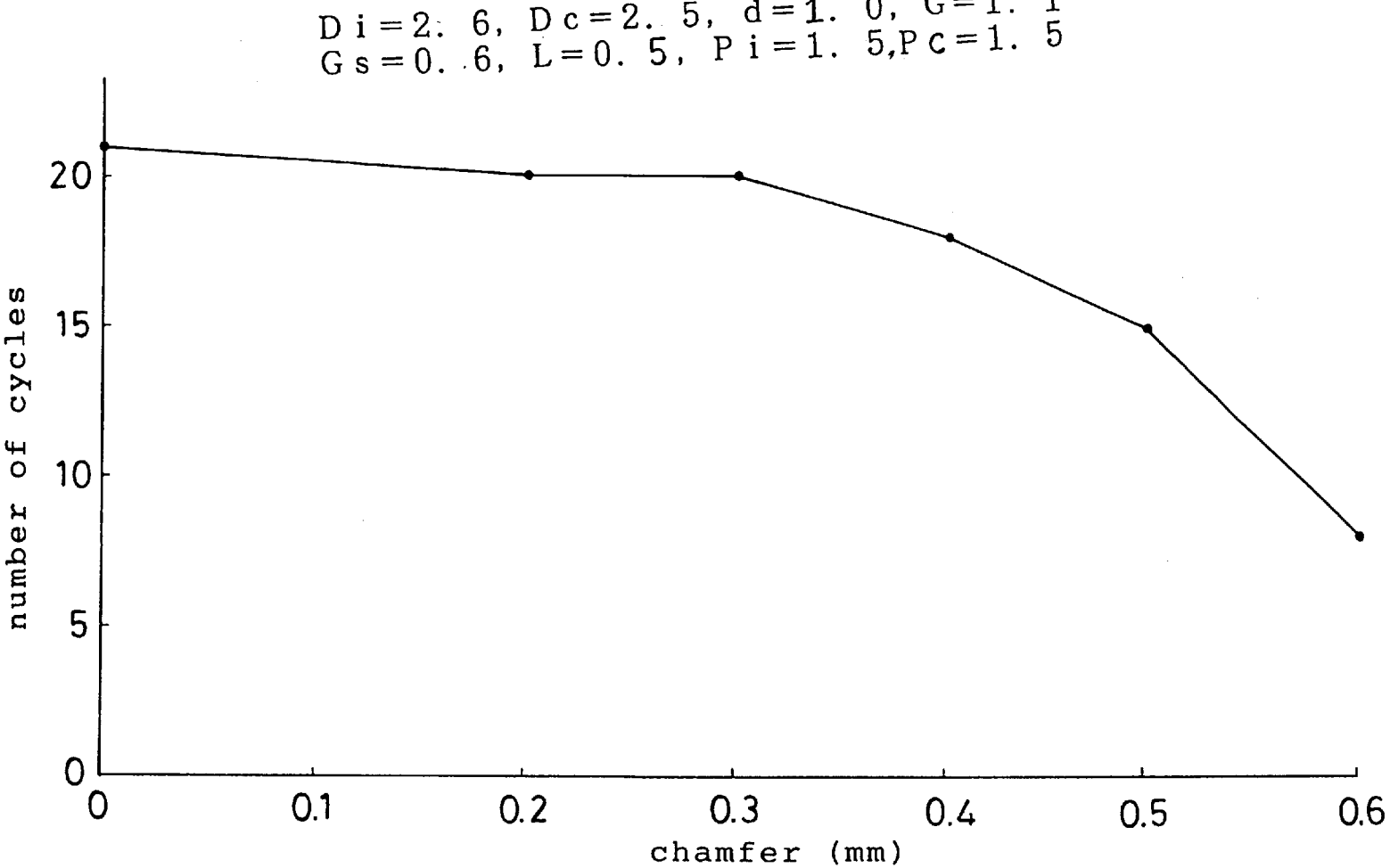
FIG. 12 is a graphical representation to show a relationship between the carbon foul resistance and a chamfering degree of an open end of the insulator.

In view of experimental test results on carbon-fouling resistance shown by FIG. 12, it was found to be advantageous when the chamfer 24 was in the range of 0.2 mm–0.4 mm since too great chamfer 24 deteriorates the carbon-fouling resistant property.

The experimental test on the carbon-fouling resistance was carried out by changing the chamfer 24.

Where, the diameter (Di) is 2.6 mm;

the diameter (Dc) is 2.5 mm;

the diameter (d) is 1.0 mm;

the spark gap (G) is 1.1 mm;

the auxiliary spark gap distance (Gs) is 0.6 mm;

the extension length (Pi) is 1.5 mm;

the distance (L) is 0.5 mm; and the projected length (Pc) is 1.5 mm.

Figure 13:
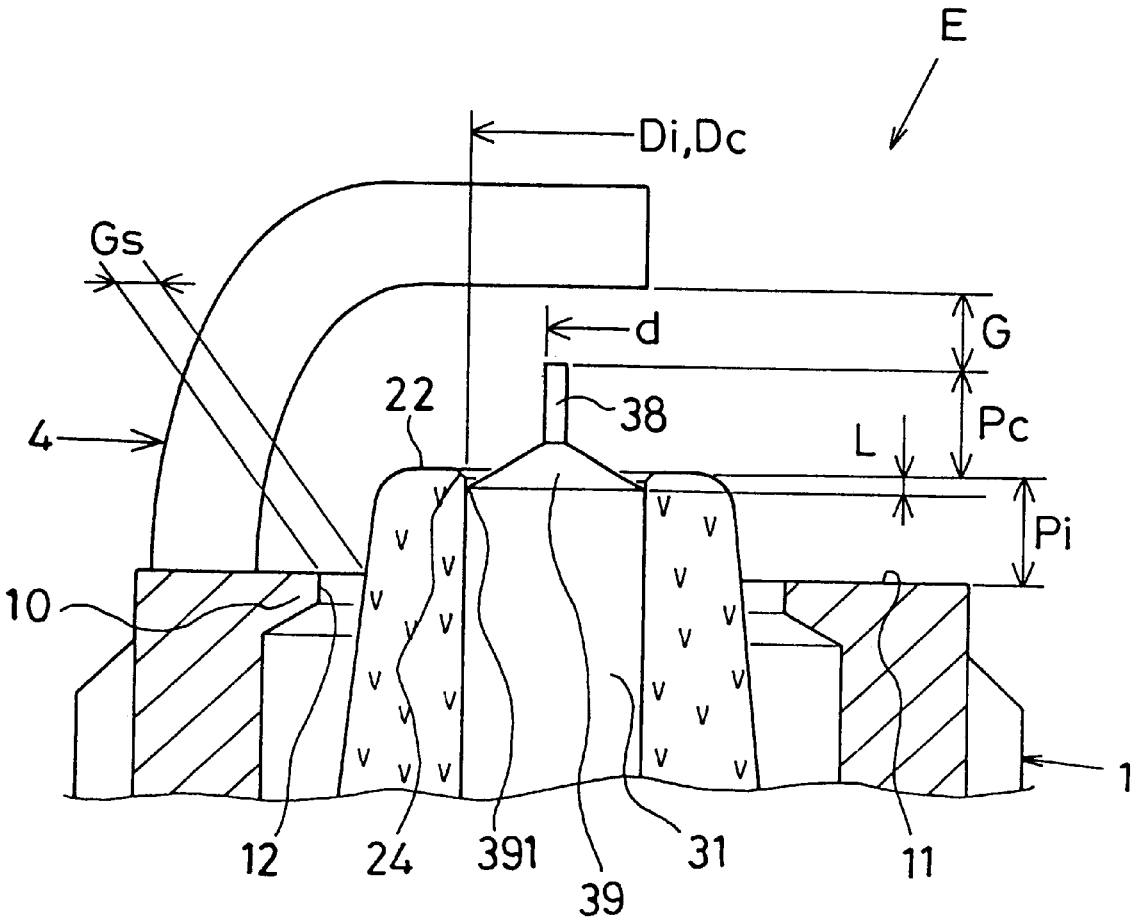
FIG. 13 is an enlarged longitudinal cross sectional view of a front end of a spark plug according to a seventh embodiment of the invention.
Figure 14:
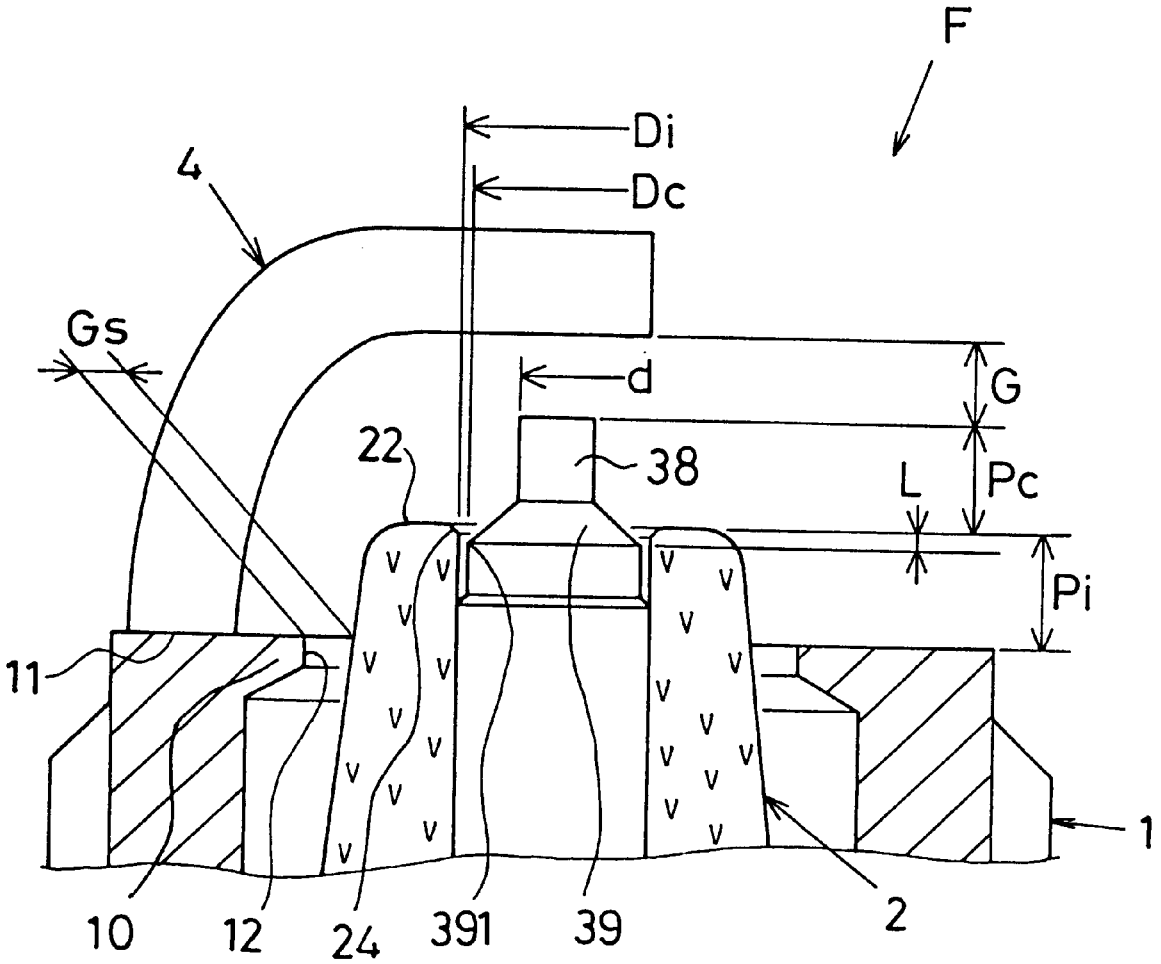
FIG. 14 is an enlarged longitudinal cross sectional view of a front end of a spark plug according to an eighth embodiment of the invention.
Figure 15:
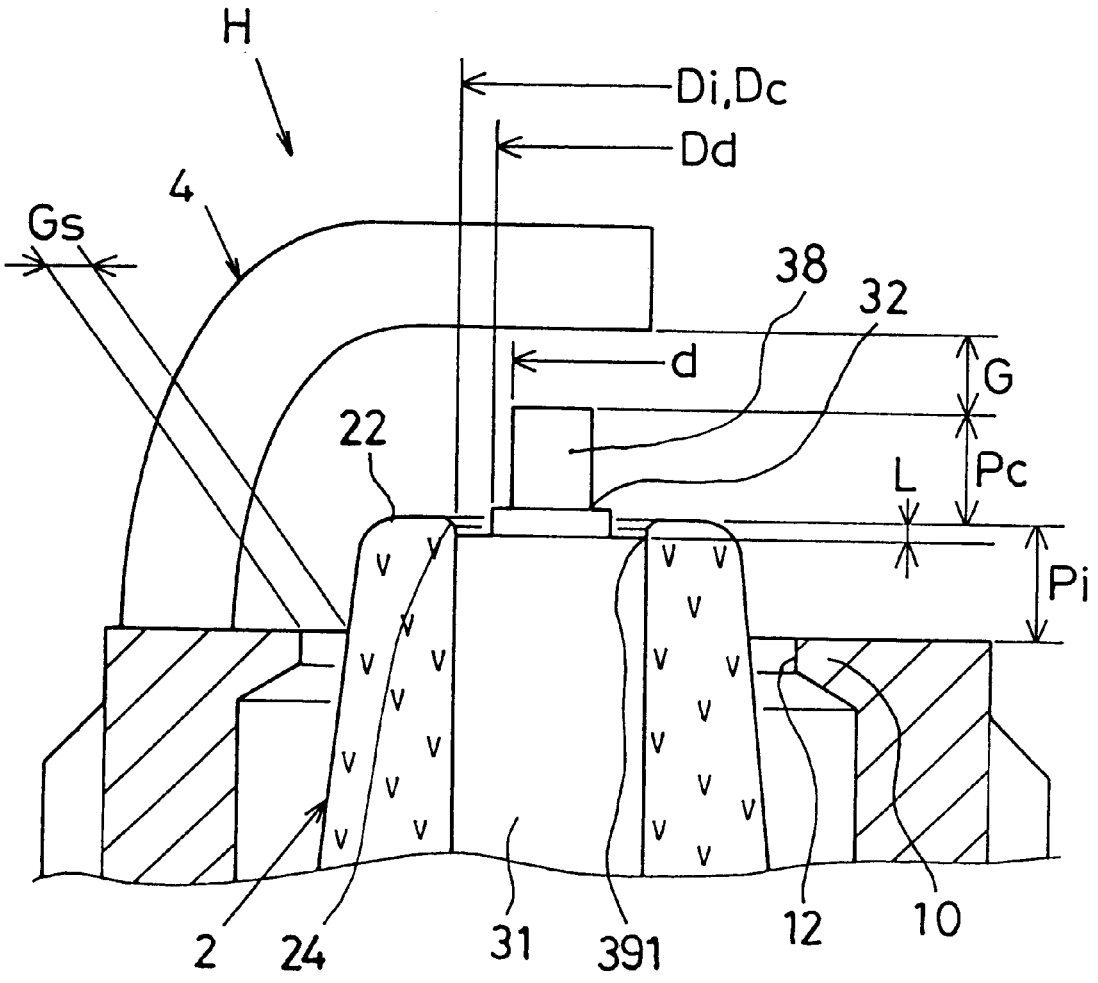
FIG. 15 is an enlarged longitudinal cross sectional view of a front end of a spark plug according to a ninth embodiment of the invention.

FIGS. 13, 14 and 15 show a seventh, eighth and ninth embodiment of the present invention respectively.

A spark plug (E) of FIG. 13 is different from the spark plug (D) of FIG. 8 in the following particulars.

Where the diameter (Di) is 2.6 mm;

the diameter (Dc) is 2.6 mm;

the diameter (d) is 0.5 mm;

the spark gap (G) is 1.1 mm;

the auxiliary spark gap distance (Gs) is 0.6 mm;

the extension length (Pi) is 1.5 mm;

the distance (L) is 0.5 mm;

the projected length (Pc) is 1.5 mm; and the chamfer 24 is 0.3 mm.

A spark plug (F) of FIG. 14 is different from the spark plug (D) of FIG. 8 in the following particulars.

Where the diameter (Di) is 2.6 mm;

the diameter (Dc) is 2.2 mm;

the diameter (d) is 0.5 mm;

the spark gap (G) is 1.1 mm;

the auxiliary spark gap distance (Gs) is 0.6 mm;

the extension length (Pi) is 1.5 mm;

the distance (L) is 0.5 mm;

the projected length (Pc) is 1.5 mm; and the chamfer 24 is 0.3 mm.

A spark plug (H) of FIG. 15 is different from the spark plug (D) of FIG. 8 in the following particulars.

Where the diameter (Di) is 2.6 mm;

the diameter (Dc) is 2.6 mm;

the diameter (d) is 0.5 mm;

the spark gap (G) is 1.1 mm;

the auxiliary spark gap distance (Gs) is 0.6 mm;

the extension length (Pi) is 1.5 mm;

the distance (L) is 0.5 mm;

the diameter (Dd) of the step portion 32 is 1.0 mm;

the projected length (Pc) is 1.5 mm; and the chamfer 24 is 0.3 mm in terms of length.

These spark plugs (E), (F) and (H) are also as superior in cabon-fouling resistance as the spark plug (D).

Figure 16:
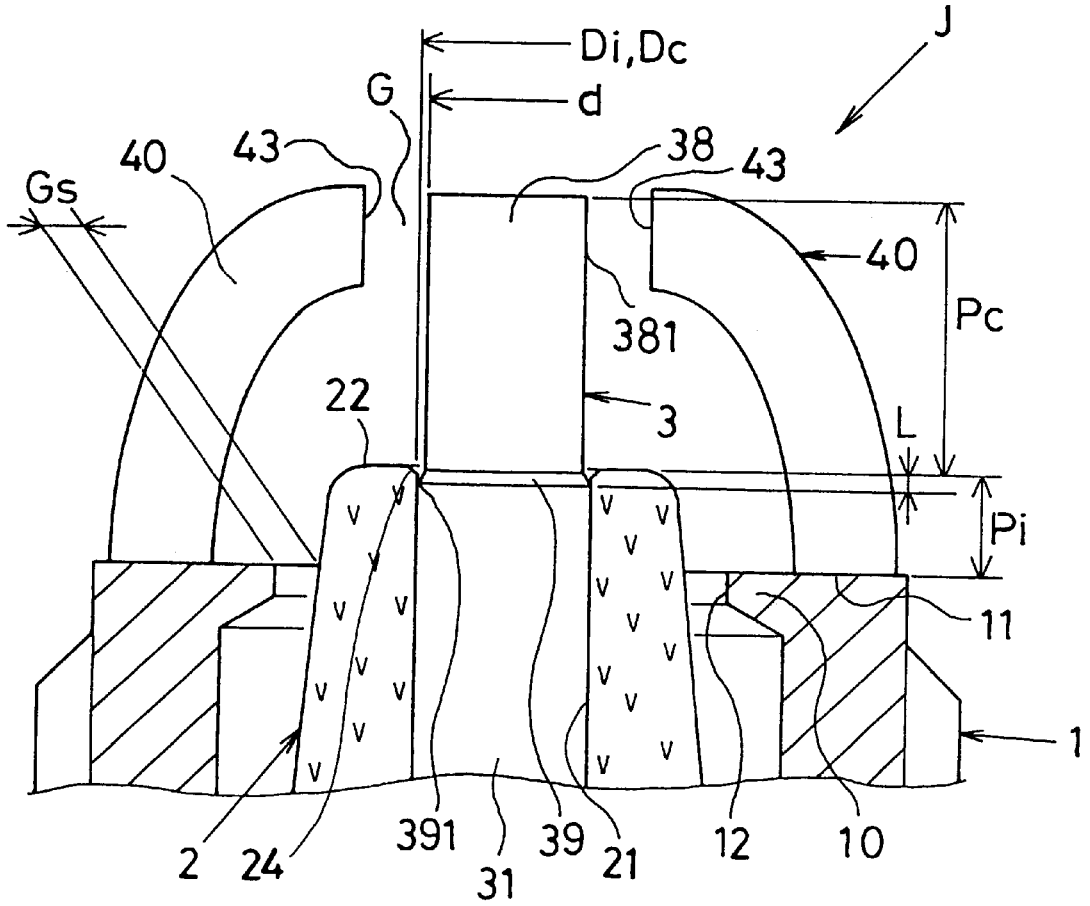
FIG. 16 is an enlarged longitudinal cross sectional view of a front end of a spark plug according to a tenth embodiment of the invention.

FIG. 16 shows a tenth embodiment of the present invention in which a spark plug (J) has the metal shell 1 whose front open end has the annular projection 10 which is oriented toward a center of the metal shell 1. The insulator 2 is firmly supported within the metal shell 1 so that the front end surface of insulator 2 extends from the front end 11 of the metal shell 1. Within the axial bore 21, the center electrode 3 is placed whose front end extends by the projected length (Pc) from the front end surface 22 of the insulator 2. To the front end 11 of the metal shell 1, the ground electrodes 40, 40 are welded whose leading ends 43, 43 face an elevational side 381 of the center electrode 3 by way of the spark gap (G) so as to discharge the sparks between the leading end 43 of the ground electrode 40 and the elevational side 381 of the center electrode 3.

The front portion of the center electrode 3 has the electrode base 31 in the axial bore 21 and the electrode front 38 whose diameter is smaller than that of the electrode base 31. The electrode base 31 is continuous to the electrode front 38 by way of the diameter-variable portion 39.

Where, the diameter (Di) is 2.6 mm;

the diameter (Dc) is 2.5 mm;

the diameter (d) is 2.0 mm;

the spark gap (G) is 0.8 mm; and the auxiliary spark gap distance (Gs) is 0.6 mm.

In this instance, the initial point 391 of the diameter-variable portion 39 is retracted inward by 0.0 mm–1.0 mm, preferably 0.1 mm–0.6 mm from the front end surface 22 of the insulator 2 in order to ameliorate the carbon-fouling resistance.

In order to improve the carbon-fouling resistance by lowering the spark discharge voltage, it is determined that the projected length (Pc) is 2.5 mm or more.

In order to prevent the cracks on the front open end of the insulator 2 due to the channeling phenomenon without losing the carbon-fouling resistance, the chamfer 24 provided on the inner wall of the front open end of the axial bore 21 is in the range of 0.1 mm–0.4 mm, preferably 0.2 mm–0.4 mm.

Figure 17:
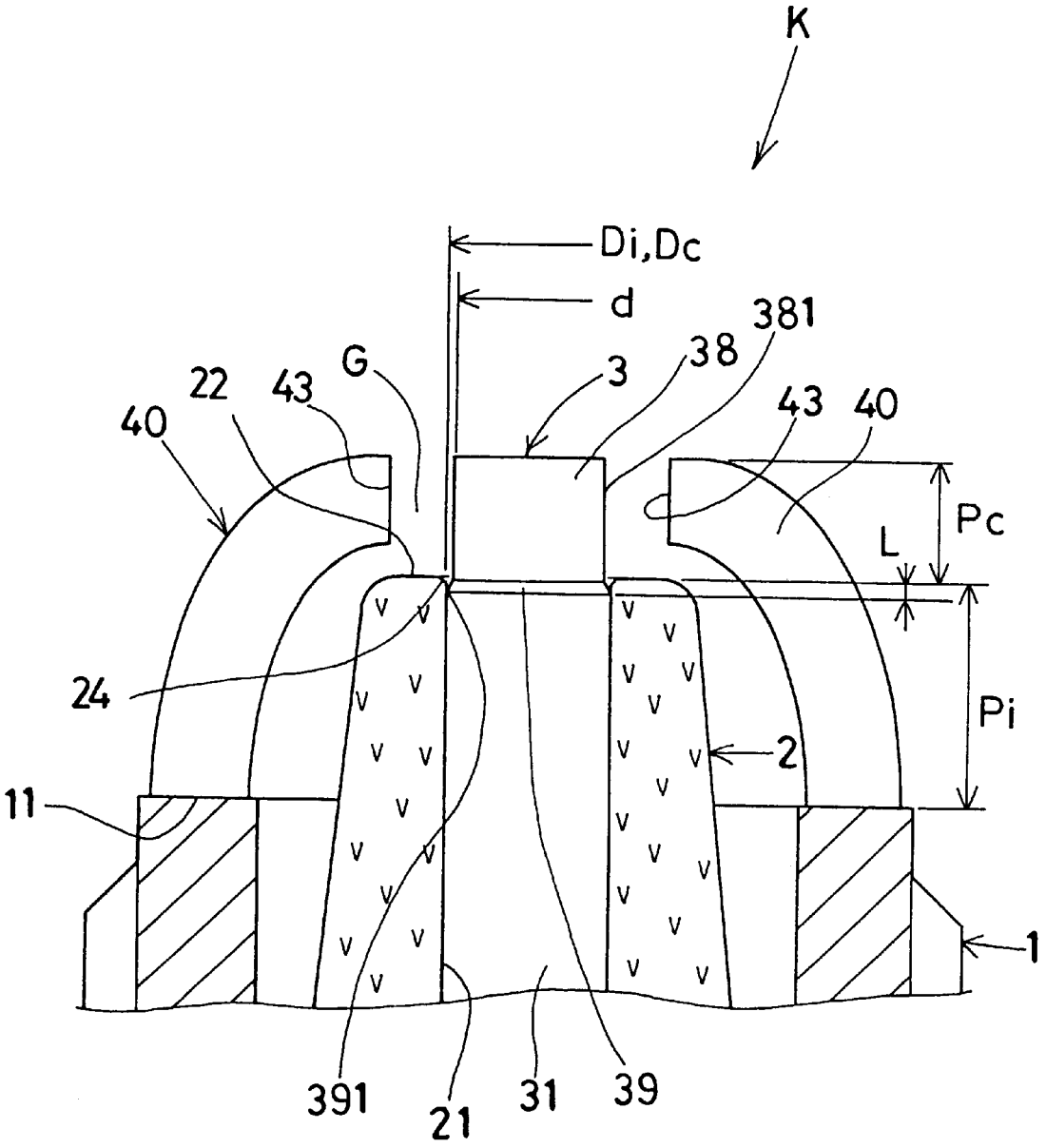
FIG. 17 is an enlarged longitudinal cross sectional view of a front end of a spark plug according to an eleventh embodiment of the invention.

FIG. 17 shows an eleventh embodiment of the present invention in which a spark plug (K) has the metal shell 1, the insulator 2 is securely placed within the metal shell 1 so that the front end surface of insulator 2 extends from the front end 11 of the metal shell 1. Within the axial bore 21, the center electrode 3 is placed whose front end extends by the projected length (Pc) from the front end surface 22 of the insulator 2. To the front end 11 of the metal shell 1, the ground electrodes 40, 40 are welded whose leading ends 43, 43 face an elevational side 381 of the center electrode 3 by way of the spark gap (G) so as to discharge the sparks between the leading end 43 of the ground electrode 40 and the elevational side 381 of the center electrode 3. Upon piling the carbon-related deposit on the front end surface 22 of the insulator 2, the semi-creeping spark discharge runs along the front end surface 22 between the ground electrode 40 and the elevational side 381 of the center electrode 3.

The front portion of the center electrode 3 has the electrode base 31 in the axial bore 21 and the electrode front 38 whose diameter is smaller than that of the electrode base 31. The electrode base 31 is continuous to the electrode front 38 by way of the diameter-variable portion 39.

Where, the diameter (Di) is 2.6 mm;

the diameter (Dc) is 2.6 mm;

the diameter (d) is 2.0 mm; and the spark gap (G) is 0.9 mm.

In this instance, the initial point 391 of the diameter-variable portion 39 is retracted inward by 0.0 mm–1.0 mm, preferably 0.1 mm–0.6 mm from the front end surface 22 of the insulator 2 in order to ameliorate the carbon-fouling resistance.

In order to improve the carbon-fouling resistance by lowering the spark discharge voltage, it is determined that the projected length (Pc) is 1.5 mm.

In order to prevent the cracks on the front open end of the insulator 2 due to the channeling phenomenon without sacrificing the carbon-fouling resistance, the chamfer 24 provided on the inner wall of the front open end of the axial bore 21 is in the range of 0.1 mm–0.4 mm, preferably 0.2 mm–0.4 mm.

Figure 18:
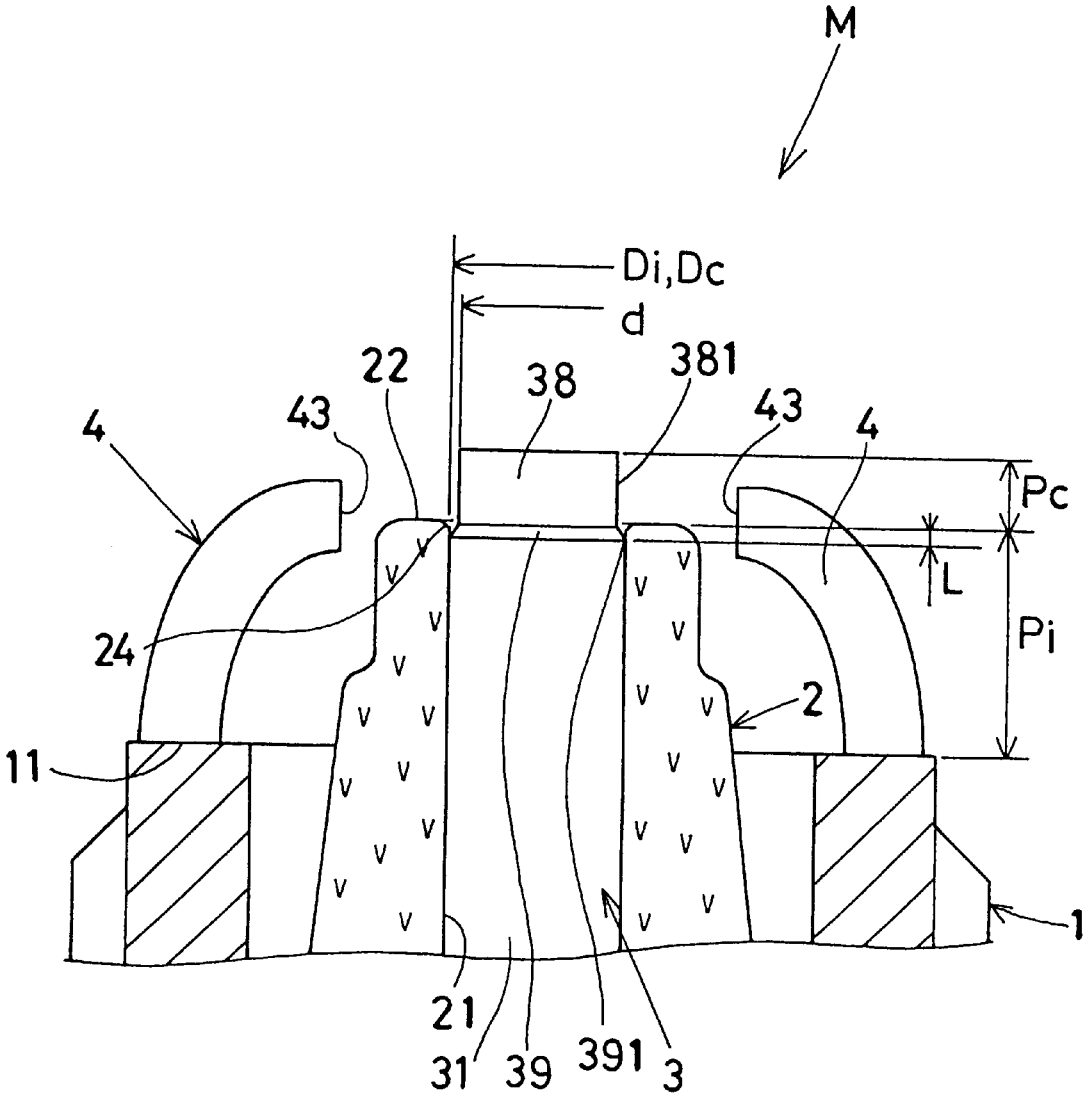
FIG. 18 is an enlarged longitudinal cross sectional view of a front end of a spark plug according to a twelfth embodiment of the invention.

FIG. 18 shows a twelfth embodiment of the present invention in which a spark plug (M) has the metal shell 1, the insulator 2 is securely placed within the metal shell 1 so that the front end surface of insulator 2 extends from the front end 11 of the metal shell 1. Within the axial bore 21, the center electrode 3 is placed whose front end extends by the projected length (Pc) from the front end surface 22 of the insulator 2. To the front end 11 of the metal shell 1, the ground electrodes 4, 4 are welded whose leading ends 43, 43 face an elevational side 381 of the center electrode 3 so as to run the semi-creeping spark discharge along the front end surface 22 of the insulator 2 between the leading end 43 of the ground electrode 4 and the elevational side 381 of the center electrode 3.

The front portion of the center electrode 3 has the electrode base 31 in the axial bore 21 and the electrode front 38 whose diameter is smaller than that of the electrode base 31. The electrode base 31 is continuous to the electrode front 38 by way of the diameter-variable portion 39.

Where, the diameter (Di) is 2.6 mm;

the diameter (Dc) is 2.6 mm; and the diameter (d) is 2.0 mm.

In this instance, the initial point 391 of the diameter-variable portion 39 is retracted inward by 0.0 mm–1.0 mm, preferably 0.1 mm–0.6 mm from the front end surface 22 of the insulator 2 in order to ameliorate the carbon-fouling resistance.

In order to improve the carbon-fouling resistance by lowering the spark discharge voltage, it is determined that the projected length (Pc) is 1.2 mm.

In order to prevent the cracks on the front open end of the insulator 2 due to the channeling phenomenon without losing the carbon-fouling resistance, the chamfer 24 provided on the inner wall of the front open end of the axial bore 21 is in the range of 0.1 mm–0.4 mm, preferably 0.2 mm–0.4 mm.

While the invention has been described with reference to the specific embodiments, it is understood that this description is not to be construed in a limitting sense in as much as various modifications and additions to the specific embodiments may be made by skilled artisan without departing the scope of the invention.

What is claimed is:

1. A spark plug for use in an internal combustion engine comprising:

an insulator having an axial bore and placed in a cylindrical metal shell with a front end of the insulator extending beyond the metal shell;

a center electrode placed within the axial bore of the insulator so that a front end of the center electrode extends beyond the insulator;

a front end portion of the center electrode having an electrode base in the axial bore and an electrode front which is diametrically smaller than the electrode base and connected thereto by a portion of variable diameter;

wherein a diametrical difference between an initial point of the variable diameter portion of the center electrode and the axial bore of the insulator is 1 mm or less, and the initial point of the variable diameter portion of the center electrode is retracted by 0.0 mm–1.0 mm from a front end surface of the insulator, said front end surface of the insulator being substantially transverse to a longitudinal axis of the axial bore of the insulator; and at least one ground electrode being secured to a front end of the metal shell directly or through the front end of the insulator so that a front end surface of the ground electrode faces an elevational side of a front end of the center electrode to form a semi-creeping spark discharge gap therebetween along the front end surface of the insulator.

2. A spark plug for an internal combustion engine comprising:

a cylindrical metal shell having an annular projection extending inwardly from a front end of the metal shell;

an insulator having an axial bore and placed in a cylindrical metal shell with a front end of the insulator extending beyond the metal shell;

a center electrode placed within the axial bore of the insulator so that a front end of the center electrode extends by 1.2 mm or more beyond the insulator;

at least one ground electrode secured to a front end of the metal shell so that a front end of the ground electrode faces an elevational side of the center electrode to form a semi-creeping spark discharge gap therebetween along a front end surface of the insulator;

a parallel ground electrode secured to a front end of the metal shell so that an inner side of the parallel ground electrode faces a front end surface of the center electrode to form an air-gap therebetween; and a front end portion of the center electrode having an electrode base in the axial bore and an electrode front which is diametrically smaller than the electrode base and connected thereto by a portion of variable diameter;

wherein a diametrical difference between an initial point of the variable diameter portion of the center electrode and the axial bore of the insulator is 1 mm or less, and the initial point of the variable diameter portion of the center electrode is retracted by 0.0 mm–1.0 mm from the front end surface of the insulator.

3. A spark plug for use in an internal combustion engine comprising:

an insulator having an axial bore and placed in a cylindrical metal shell with a front end of the insulator extending beyond the metal shell;

a center electrode placed within the axial bore of the insulator so that a front end of the center electrode extends beyond the insulator;

at least one ground electrode secured to a front end of the metal shell; and a front end portion of the center electrode having an electrode base in the axial bore and an electrode front which is diametrically smaller than the electrode base and, connected thereto by a portion of a variable diameter portion;

wherein a diametrical difference between an initial point of the variable diameter portion of the center electrode and the axial bore of the insulator is 1 mm or less, and the initial point of the variable diameter portion of the center electrode is retracted by 0.0 mm–1.0 mm from a front end surface of the insulator, said front end surface of the insulator being substantially transverse to a longitudinal axis of the axial bore of the insulator.

4. A spark plug for use in an internal combustion engine comprising:

a cylindrical metal shell;

an insulator having an axial bore and placed in said cylindrical metal shell with a front end of the insulator extending beyond the metal shell;

a center electrode placed within the axial bore of the insulator so that a front end of the center electrode extends beyond the insulator;

at least one ground electrode secured to a front end of the metal shell; and a front end portion of the center electrode having an electrode base in the axial bore and an electrode front which is diametrically smaller than the electrode base and connected thereto by a portion of variable diameter;

wherein a diametrical difference between an initial point of the variable diameter portion of the center electrode and the axial bore of the insulator is 1 mm or less, and the initial point of the variable diameter portion of the center electrode is retracted by 0.0 mm–1.0 mm from a front end surface of the insulator; and wherein the cylindrical metal shell has an annular projection extending inwardly from a front end of the metal shell such that the center electrode forms an auxiliary spark gap with the annular projection of the metal shell.

5. A spark plug as recited in any of claims 1 to 4, wherein the variable diameter portion is formed into a frusto-cone shaped configuration, and a diameter-reduced front end of the variable diameter portion is diametrically the same as the electrode front of the center electrode, and a diameter-enlarged rear end of the variable diameter portion is retracted by 0.0 mm–1.0 mm from the front end surface of the insulator.

6. A spark plug as recited in any of claims 1 to 4, wherein the initial point of the variable diameter portion of the center electrode is retracted by 0.1 mm–0.6 mm from the front end surface of the insulator.

7. A spark plug as recited in any of claims 1 to 4, wherein a diameter of the electrode base of the center electrode is 1.5 mm or less.

8. A spark plug as recited in any of claims 1 to 4, wherein a noble metal tip is secured to a firing side defined at least on either the front end surface or the elevational side of the center electrode.

9. A spark plug as recited in any of claims 1 to 4, wherein a noble metal tip is secured to a firing side defined at least on either the front end surface of the ground electrode, the annular projection of the metal shell or the inner side of the parallel ground electrode.

10. A spark plug as recited in any of claims 1 to 4, wherein an inner edge of a front open end of the insulator is chamfered by 0.2 mm to 0.4 mm in length.

11. A spark plug as recited in any of claim 1, 3 or 2, wherein the number of the ground electrodes is three or more.

12. A spark plug as recited in claim 8, wherein the noble metal tip is made of Pt, Pt-Ni, Pt-Ir-Ni or Ir-Y2O3.

13. A spark plug as recited in claim 8, wherein the noble metal tip is laser beam or resistance welded in integration with the electrode.

14. A spark plug as recited in claim 8, wherein the noble metal tip measures 0.6 mm–1.5 mm in diameter.

15. A spark plug as recited in any of claims 1 to 4, wherein the variable diameter portion is formed into a frusto-cone shaped configuration, and a front end of the variable diameter portion serves as an edge portion which is retracted by 0.0 mm–1.0 mm from the front end surface of the insulator.

16. A spark plug as recited in any of claims 1 to 4, wherein the variable diameter portion is formed into a column-shaped configuration, and a front end of the variable diameter portion serves as an edge portion which is retracted by 0.0 mm–1.0 mm from the front end surface of the insulator.

17. A spark plug as recited in claim 9, wherein the noble metal tip measures 0.6 mm–1.5 mm in diameter.

18. A spark plug as recited in claim 9, wherein the noble metal tip is made of Pt, Pt-Ni, Pt-Ir-Ni or Ir-Y2O3.

19. A spark plug as recited in claim 9, wherein the noble metal tip is laser beam or resistance welded in integration with the electrode.

* * * * *